US007283147B2

(12) United States Patent
Sago et al.

(10) Patent No.: US 7,283,147 B2
(45) Date of Patent: Oct. 16, 2007

(54) PRINTER

(75) Inventors: Akira Sago, Seto (JP); Keiji Seo, Nagoya (JP); Teruo Imamaki, Nisshin (JP); Takashi Higashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 228 days.

(21) Appl. No.: 11/149,315

(22) Filed: Jun. 10, 2005

(65) Prior Publication Data

US 2006/0007294 A1 Jan. 12, 2006

(30) Foreign Application Priority Data

Jul. 9, 2004 (JP) ..... 2004-203567

(51) Int. Cl.
*B41J 25/312* (2006.01)

(52) U.S. Cl. ..... 347/198; 400/120.17

(58) Field of Classification Search ..... 347/198; 400/120.17

See application file for complete search history.

(56) References Cited

U.S. PATENT DOCUMENTS 5,612,727 A 3/1997 Morimoto et al.
5,678,938 A * 10/1997 Saito et al. ..... 400/120.17
6,398,434 B1 6/2002 Corrigan, Jr.
2002/0080223 A1* 6/2002 Connor ..... 347/198

FOREIGN PATENT DOCUMENTS

EP 0 700 789 A1 3/1996
JP A 01-170164 7/1989

* cited by examiner

*Primary Examiner*—Huan Tran
(74) *Attorney, Agent, or Firm*—Oliff & Berridge, PLC

(57) ABSTRACT

A roll sheet is unwound and fed with its side edge being positioned in a reference point of the thermal head, and then subjected to printing by the thermal head. Coil springs are placed at positions respectively dividing substantially equally a length from a center to each end of the thermal head. A distribution of loads on the thermal head by each coil spring is determined so that a load exerted on the thermal head on the reference point side is larger than a load exerted on the thermal head on the opposite side. A position of a resultant force of the coil springs acts on the thermal head at a position displaced by a distance obtained by multiplying an entire length of the thermal head by a coefficient, from a center of the thermal head in the longitudinal direction toward the reference point.

8 Claims, 16 Drawing Sheets

FIG.14

79

| $\alpha$ VALUE | $\alpha < 0.004$ | 0.004～0.029 | $0.029 < \alpha$ |
|---|---|---|---|
| PRINT RESULTS | FAINT PRINTS ON SHEET FOR RIGHT END OF THERMAL HEAD | GOOD | FAINT PRINTS ON SHEET FOR LEFT END OF THERMAL HEAD |

PRINTER

BACKGROUND OF THE INVENTION

1. Field of the Invention

The present invention relates to a printer arranged to print on any printing media of different widths while feeding the printing medium with a platen roller so that one side edge of the printing medium is positioned near one end of a thermal head.

2. Description of Related Art

Some conventional printers are arranged to print on any roll sheet or paper having different widths while feeding the sheet or paper with a platen roller so that one side edge of the sheet or paper is positioned near one end of a thermal head.

For instance, there has been proposed a printer provided with a printing unit including a thermal head, a thermal ink sheet to be supplied through a supply shaft and a winding shaft which are placed on both sides of the thermal head, and a transfer roller pressed against the thermal head. In this printer, a copy paper is transported to a nip point formed between the thermal ink sheet and the transfer roller, the paper being guided as held so that one side edge of the paper is positioned near one end of the thermal head. Only a pressing force of the transfer roller exerted on the thermal head on a side to which the paper is guided and fed can be adjusted to increase or decrease (for example, Japanese patent application laid-open publication No. H1(1989)-170164).

With this structure, the pressing force on the guided and fed side is reduced if the paper is a thin sheet and increased if the paper is a thick, particularly, narrow sheet (e.g., a postcard, a business card, etc.). Accordingly, various types of paper different in width and thickness can uniformly be printed.

In the above conventional printer, the platen roller is moved up and down to press the thermal head. This may cause displacement between the thermal head and the platen roller and displacement of components for a driving system. Thus, the printing accuracy and the feeding accuracy are likely to deteriorate.

To avoid the above disadvantages, for example, a tape printer 101 as shown in FIGS. 17A and 17B has been proposed. In this printer, a platen roller 102 is rotatably supported on side walls 103 and 104 of a frame through bearings 105 and 106 respectively. A thermal head 109 mounted on a head support member 108 is pressed against a peripheral surface of the platen roller 103 by coil springs 110 and 111. The coil springs 110 and 111 are formed to have a substantially equal pressing force and placed to divide substantially equally each length from a center of the thermal head 109 to each end thereof in a width direction.

As shown in FIG. 17A, in the case where a wide roll sheet 112 having a substantially equal width to the length of the thermal head 109 is fed while a side edge (a right edge in FIG. 17A) of the roll sheet 112 is positioned in a reference point 113 near one end (a right end in FIG. 17A) of the thermal head 109 in its longitudinal direction, the thermal head 109 can be brought into contact under substantially uniform pressure with the entire roll sheet 112.

As shown in FIG. 17B, however, in the case where a narrow roll sheet 112 having a width about half the length of the thermal head 109, the head support member 118 would be inclined when a side edge (a right edge in FIG. 17B) of the roll sheet 112 is positioned in the reference point 113. The thermal head 109 cannot be pressed under uniform pressure against the entire roll sheet 112. This would cause a large reduction in print quality of the roll sheet 112 on the reference point 113 side.

SUMMARY OF THE INVENTION

The present invention has been made in view of the above circumstances and has an object to overcome the above problems and to provide a printer with a simple structure capable of bringing a thermal head into contact under substantially uniform pressure with an entire printing medium having a width about half the length of the thermal head to print with high quality even when the printing medium is fed while its side edge is positioned near one end of the thermal head.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a printer comprising: a frame having a pair of side walls; a head support member holding a thermal head; a platen roller rotatably supported on the pair of side walls; a plurality of elastic members arranged along a longitudinal direction of the head support member to bring the thermal head into contact with a peripheral surface of the platen roller under predetermined loads; and a feeding mechanism which feeds an unwound part of a printing medium while positioning a side edge of the unwound part near one end of the thermal head according to a width of the printing medium selected from among a plurality of printing media having different widths, wherein the predetermined loads by the plurality of elastic members are determined such that a load exerted on the one end of the thermal head is larger than a load exerted on the other end of the thermal head.

In the above printer, the platen roller is rotatably mounted on the pair of side walls of the frame, the thermal head held on the head support member is brought into contact with the peripheral surface of the platen roller under a predetermined load by the plurality of elastic members. The printing medium is fed with its side edge being positioned near one end of the thermal head according to any one of plural widths, and subjected to printing by the thermal head. The predetermined loads by the elastic members are determined so that the load exerted on the one end of the thermal head close to which the side edge of the printing medium is positioned is larger than the load exerted on the other end of the thermal head.

Accordingly, even when the printing medium having the width about half the length of the thermal head is fed with the side edge being positioned near the one end of the thermal head, the thermal head can be brought into contact under substantially uniform pressure with the entire printing medium. This makes it possible to enhance the printing accuracy and the feeding accuracy and to print with high quality. The elastic members are simply designed to have predetermined loads so that the load exerted on the one end of the thermal head in which the side edge of the printing medium is positioned is larger than the load exerted on the other end of the thermal head. Consequently, the need to change the positions of the elastic members can be eliminated and print quality can be enhanced with a simple structure.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings,

FIG. 14 is a table showing print results provided by the tape printer in the first embodiment, in which the roll sheet having the width about half the maximum width is mounted and a position of the resultant force is changed;

DETAILED DESCRIPTION OF THE PREFERRED EMBODIMENTS

A detailed description of first through third preferred embodiments of a tape printer embodying the present invention will now be given referring to the accompanying drawings.

First Embodiment

Firstly, a schematic structure of a tape printer in the first embodiment will be explained with reference to FIGS. 1 to 8.

Figure 1:
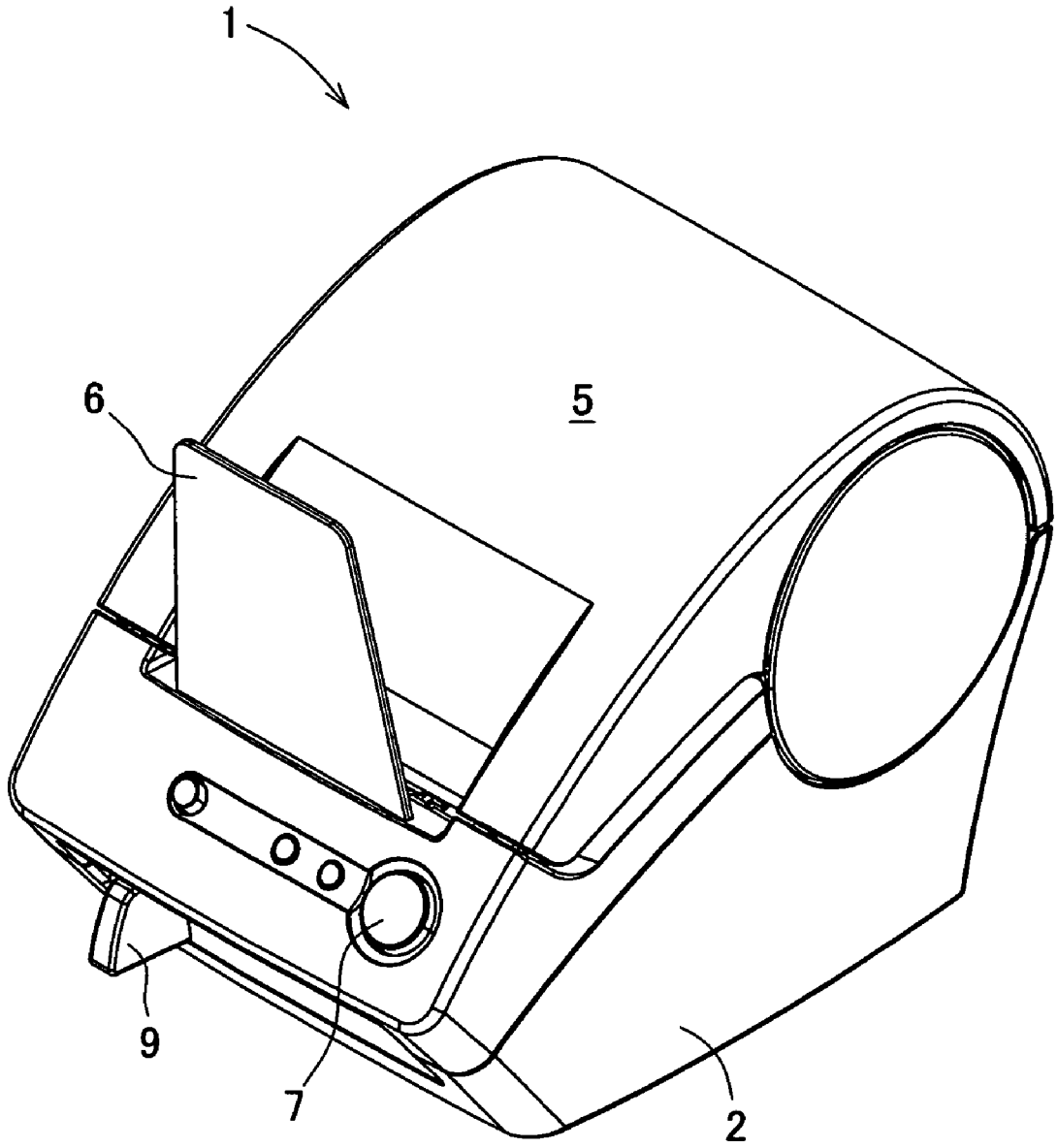
FIG. 1 is a schematic perspective view of a tape printer in a first embodiment.
Figure 2B:
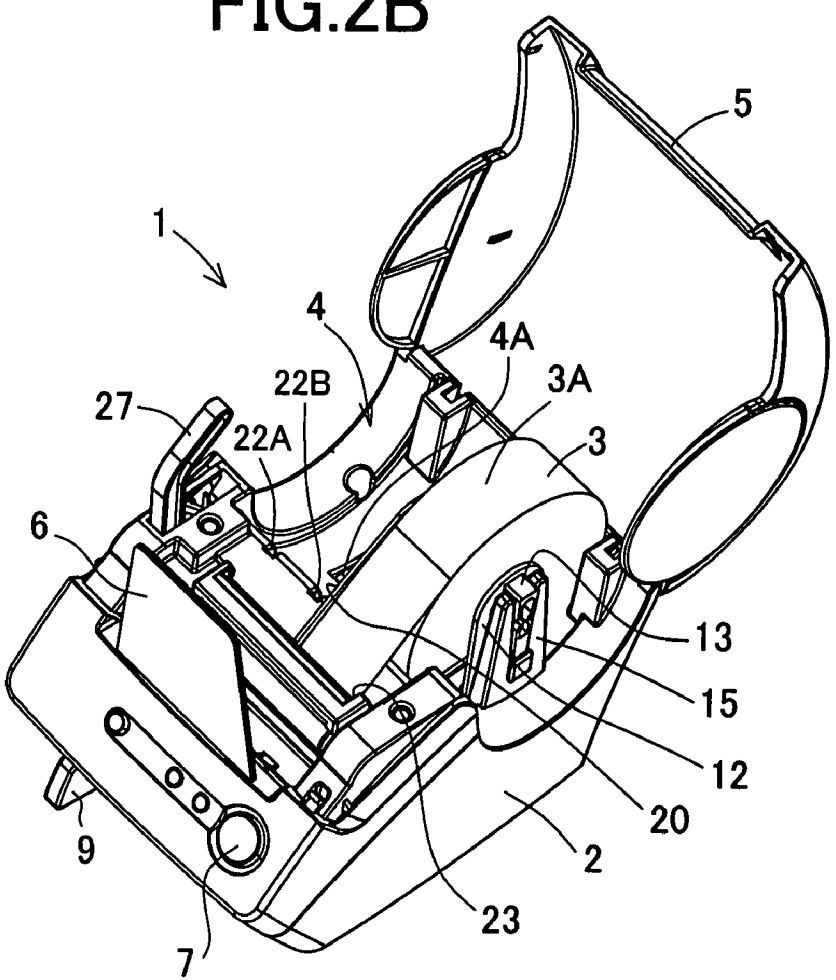
FIG. 2B is a perspective view of the tape printer in which a roll sheet holder holding a roll sheet of a width about half the maximum width is mounted.
Figure 2A:
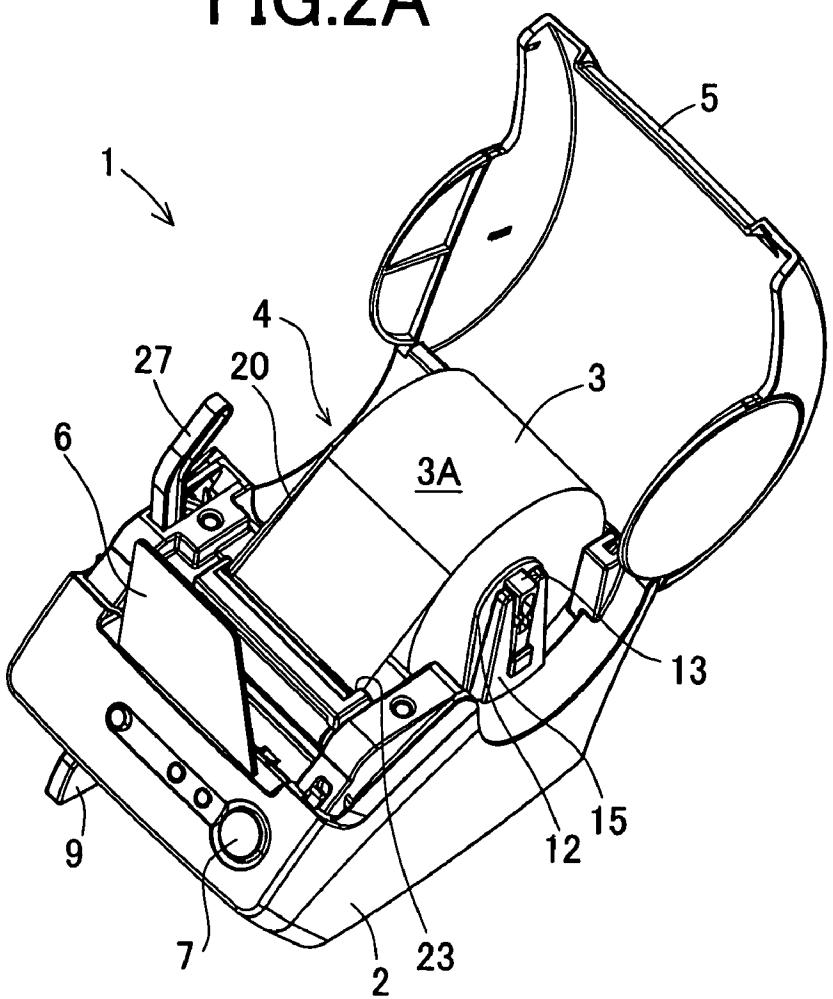
FIG. 2A is a perspective view of the tape printer in which a roll sheet holder holding a roll sheet of a maximum width is mounted.
Figure 3:
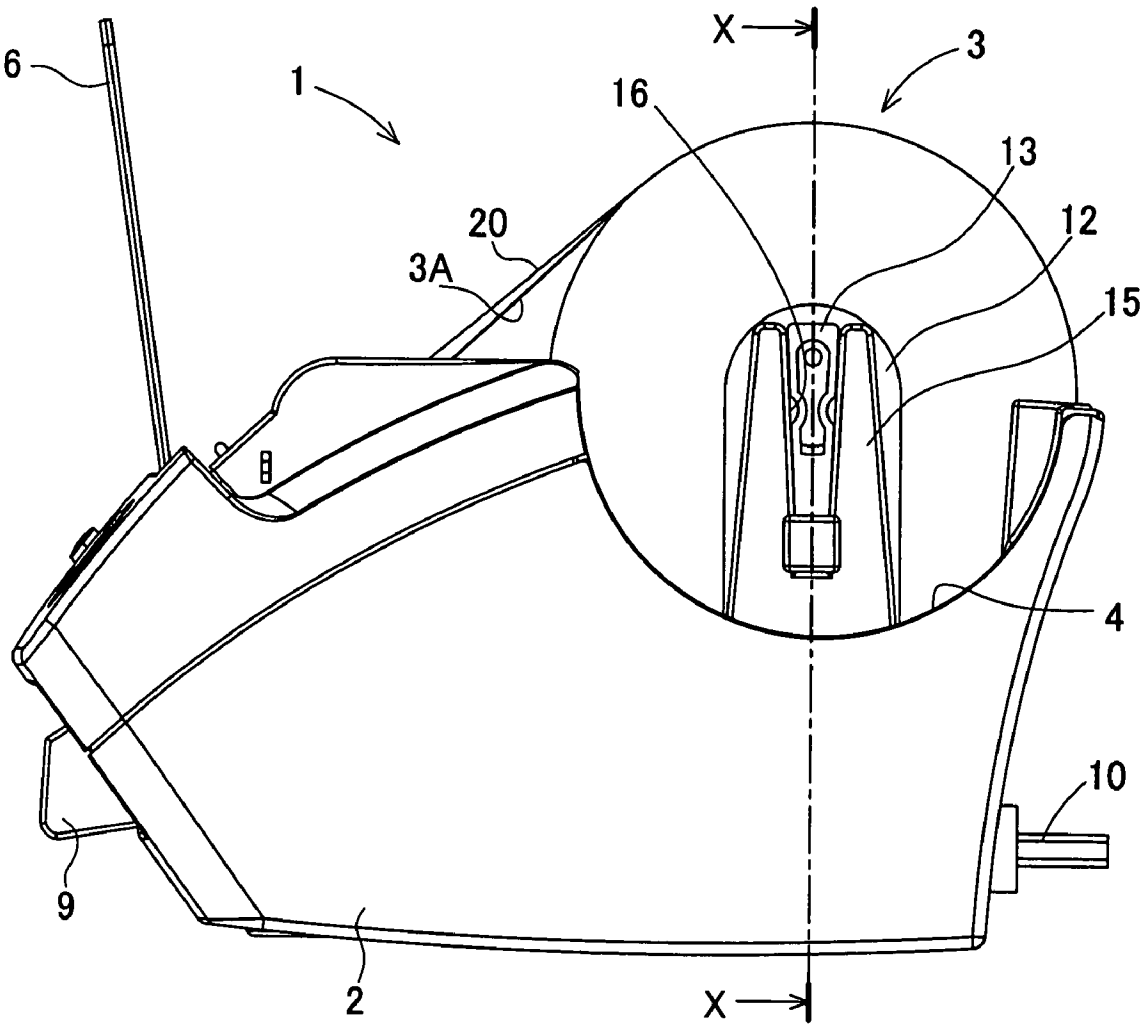
FIG. 3 is a side view of the tape printer in the first embodiment, from which a top cover is removed and in which the roll sheet holder holding the roll sheet of the maximum width is mounted.

As shown in FIGS. 1 to 3, a tape printer 1 includes a housing (main body) 2, a top cover 5 made of transparent resin attached to the housing 2 at a rear upper edge, a tray 6 made of transparent resin disposed in a standing position to face to a substantially front center of the top cover 5, a power button 7 placed in front of the tray 6, a cutter lever 9 movable side to side to horizontally move a cutter unit 8 (see FIG. 7), and others. The top cover 5 is freely opened and closed, thereby covering an upper part of a roll sheet holder storage part (hereinafter, a "holder storage part") 4 which is a space for receiving a roll sheet holder 3 holding a roll sheet 3A of a predetermined width. A power cord 10 is connected to the housing 2 on a back face near a corner. The housing 2 is provided on the back face near the other corner with a connector part 11 (see FIG. 6) such as a USB (Universal Serial Bus) which is connected to for example a personal computer not shown. The roll sheet 3A is formed of a long thermal sheet (so-called "thermal paper") having a self color development property or a long label sheet formed of the thermal sheet whose one surface is bonded with a release sheet with an adhesive. The roll sheet 3A is in a wound state around a hollow cylindrical sheet core 3B (see FIG. 4).

As shown in FIGS. 2 through 6, the tape printer 1 is provided with a holder support member 15 in the holder storage part 4 at a side end (a left side end in FIG. 6) in a substantially perpendicular direction to a sheet feeding direction. The holder support member 15 receives a mounting piece 13 of a positioning holding member (hereinafter, a "holding member") 12 constructing the roll sheet holder 3 mentioned later. The mounting piece 13 is provided protruding in a substantially rectangular shape in section on an outer surface of the holding member 12. Specifically, the holder support member 15 is shaped like an angled U-shape as seen in side view (FIG. 3) of the printer 1, providing a first positioning groove 16 which opens upward. The holder support member 15 is also formed with a recess 15A which engages an elastic locking piece 12A formed projecting at a lower end of the holding member 12.

Figure 7:
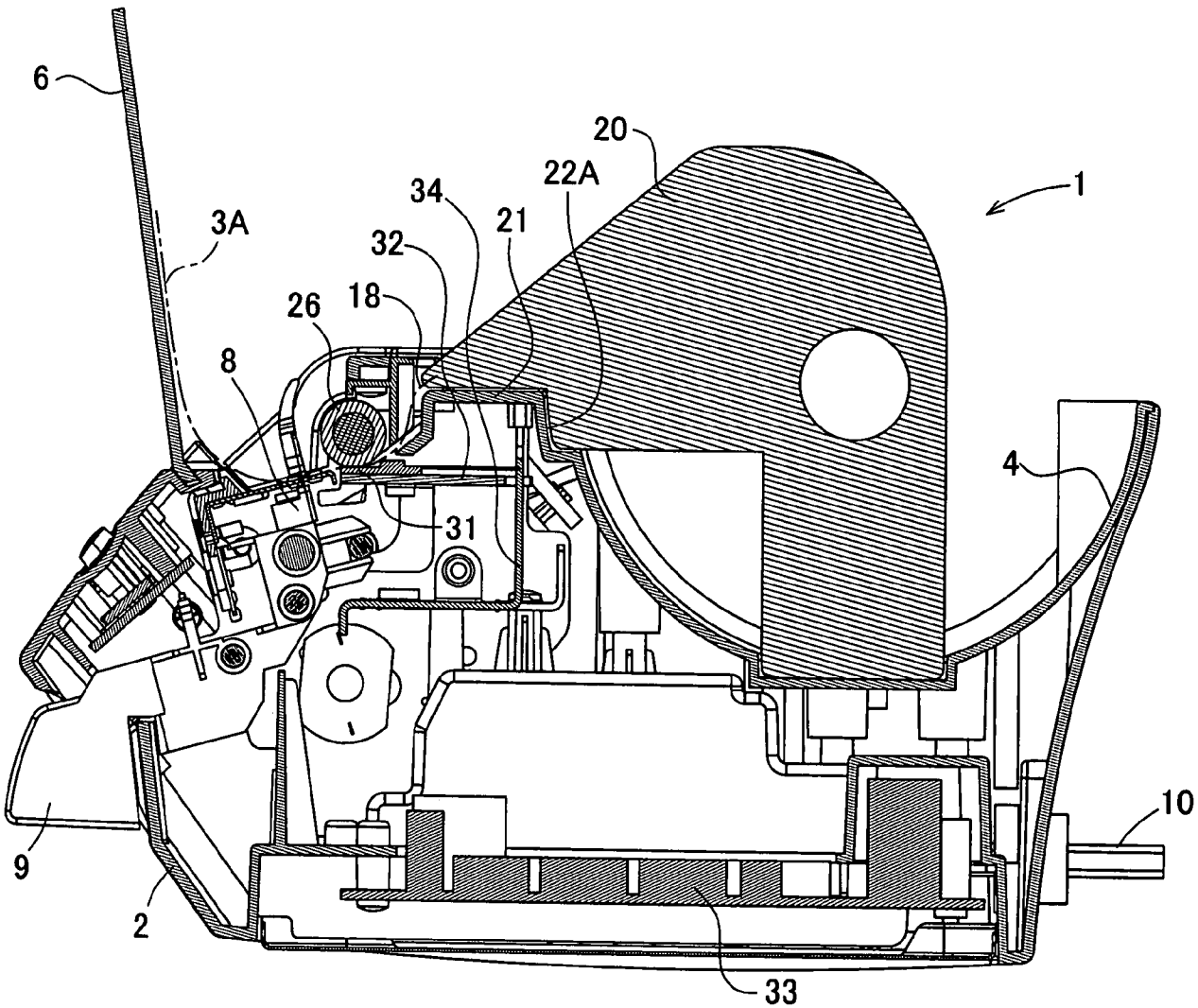
FIG. 7 is a sectional side view of the tape printer in which a roll sheet holder is mounted and from which the top cover is removed.

The housing 2 is formed with an insertion port 18 into which a leading end of an unwound part of the roll sheet 3A is inserted. A flat portion 21 is formed to be substantially horizontal between a rear end (in the feeding direction) of the port 18 and a front upper edge portion of the holder storage part 4. On this flat portion 21, a front end of a guide member 20 of the roll sheet holder 3 is placed. The flat portion 21 is provided at a rear corner in the feeding direction with second positioning grooves (four grooves in the present embodiment) 22A to 22D each formed by a substantially L-shaped wall in section and positioned corresponding to each of a plurality of roll sheets 3A of different widths. Each of the second positioning grooves 22A to 22D is configured to fittingly receive a front part of the guide member 20 inserted from above, as shown in FIG. 7. Further, the front end of the guide member 20 of the roll sheet holder 3 extends to the insertion port 18.

A positioning recess 4A is formed in the bottom of the holder storage part 4. The positioning recess 4A is rectangular in plan view and long sideways in a direction substantially perpendicular to the feeding direction, extending from an inner base end of the holder support member 15 to a position corresponding to the second positioning groove 22A. This positioning recess 4A has a predetermined depth (about 1.5 mm to 3.0 mm in the first embodiment). The width of the positioning recess 4A in the feeding direction is determined to be almost equal to the width of each lower end portion of the holding member 12 and the guide member 20. A discrimination recess 4B is provided between the positioning recess 4A and the inner base end of the holder support member 15. This discrimination recess 4B is rectangular in plan view, which is long in the feeding direction, and has a depth larger by a predetermined amount (about 1.5 mm to 3.0 mm in the first embodiment) than the positioning recess 4A. The discrimination recess 4B will receive a sheet discrimination part 60 (see FIG. 8) mentioned later which extends inward from the lower end of the holding member 12 at a right angle therewith. In the discrimination recess 4B, there are provided five sheet discrimination sensors S1, S2, S3, S4, and S5 arranged in an L-shaped pattern for distinguishing the kind (e.g., width) of the roll sheet 3A. These sensors S1 to S5 are each constructed of a well known mechanical switch including a plunger and a push-type microswitch. It is detected whether the sheet discrimination part 60 has sensor holes (through holes) 60A (see FIG. 8B), mentioned later, at the positions corresponding to the sheet discrimination sensors S1 to S5 respectively. Based on an ON/OFF signal of each sensor S1 to S5, the kind of the roll sheet 3A set in the roll sheet holder 3 is detected. In the first embodiment, the tape discrimination sensors S1 to S5 are allowed to normally protrude from the bottom surface of the discrimination recess 4B. At this time, each microswitch is in an OFF state. In the case where the sheet discrimination part 60 has some sensor hole(s) 60A at the positions corresponding to the sheet discrimination sensors S1 to S5, the plunger(s) of the sensor(s) for which the sheet discrimination part 60 has sensor hole(s) is allowed to pass through the associated sensor holes 60A without depression, leaving the corresponding microswitch(es) in the OFF state, which generates an OFF signal. On the other hand, the plunger(s) of the sensor(s) for which the sheet discrimination part 60 has no sensor hole(s) is depressed, bringing the corresponding microswitch(es) into the ON state, which generates an ON signal.

The insertion port 18 is arranged so that its one side end (a left end in FIG. 6) on the holder support member 15 side is substantially flush with the inner surface of the positioning member 12 when engaged in the holder support member 15. A guide rib 23 is formed at the side end of the insertion port 18 on the holder support member 15 side. A lever 27 for operating a vertical movement of a thermal head 31 of a line type (see FIG. 7) is provided in front of the other side end (a left end in FIG. 5) of the holder storage part 4 in the feeding direction.

Figure 8:
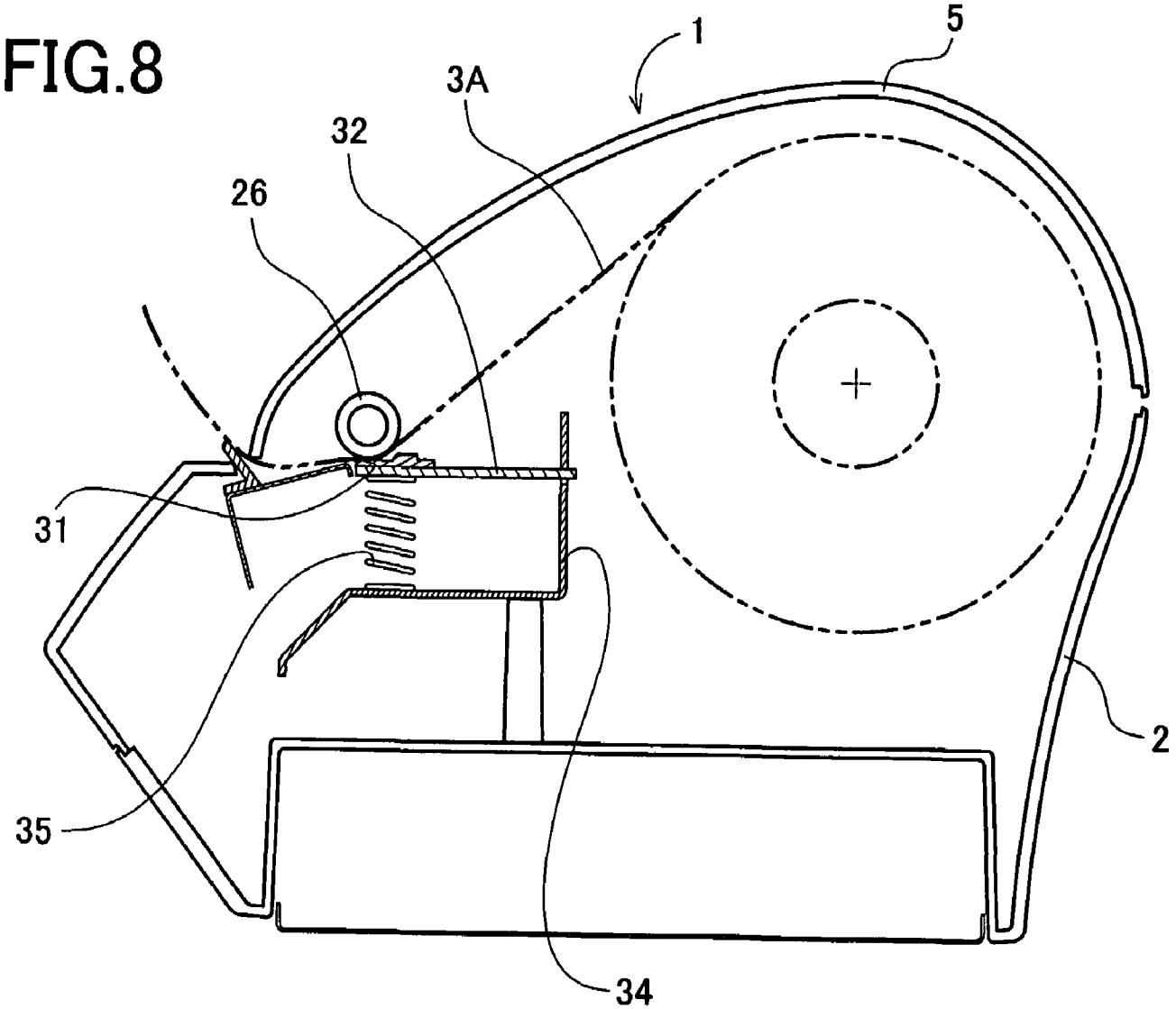
FIG. 8 is a sectional side view of the tape printer in the first embodiment, during a printing operation.

Herein, as shown in FIGS. 7 and 8, when the lever 27 is turned up, a head support member 32 holding thereon the thermal head 31 is turned down, separating the thermal head 31 from a platen roller 26 (see FIG. 7). When the lever 27 is turned down, the head support member 32 is turned up, causing the thermal head 31 to press the part of the roll sheet 3A inserted through the insertion port 18 against the platen roller 26 by pressing forces of coil springs 35 and 36 (see FIG. 12) placed between a bottom face of a frame 34 and the head support member 32 as mentioned later. Thus, the printer is placed in a printing enabled state.

Further, a control circuit 33 is provided below the roll sheet holder 4. This control circuit 33 drives and controls each mechanism in response to commands from an external personal computer and others. The thermal head 31 is driven and controlled while the platen roller 26 is rotated by a stepping motor or the like not shown, so that image data can be printed in sequence on a printing surface of the roll sheet 3A being transported. The printed part of the roll sheet 3A discharged onto the tray 6 is cut with the cutter unit 8 when the cutter lever 9 is operated to move rightward in FIG. 1.

A schematic structure of the roll sheet holder 3 will be described below, referring to FIGS. 4 and 9.

Figure 4:
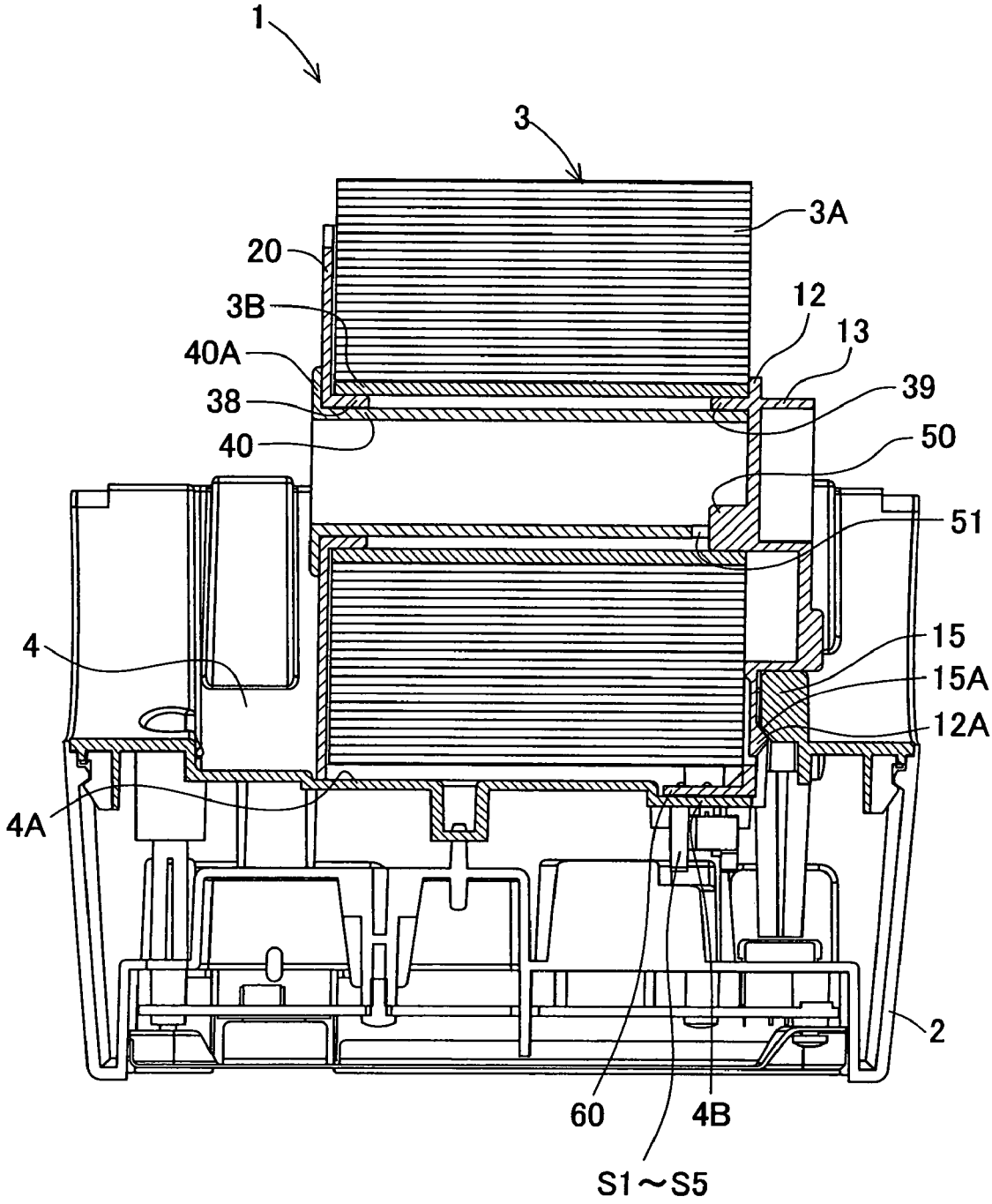
FIG. 4 is a sectional view of the tape printer taken along a line X-X in FIG. 3.
Figure 5:
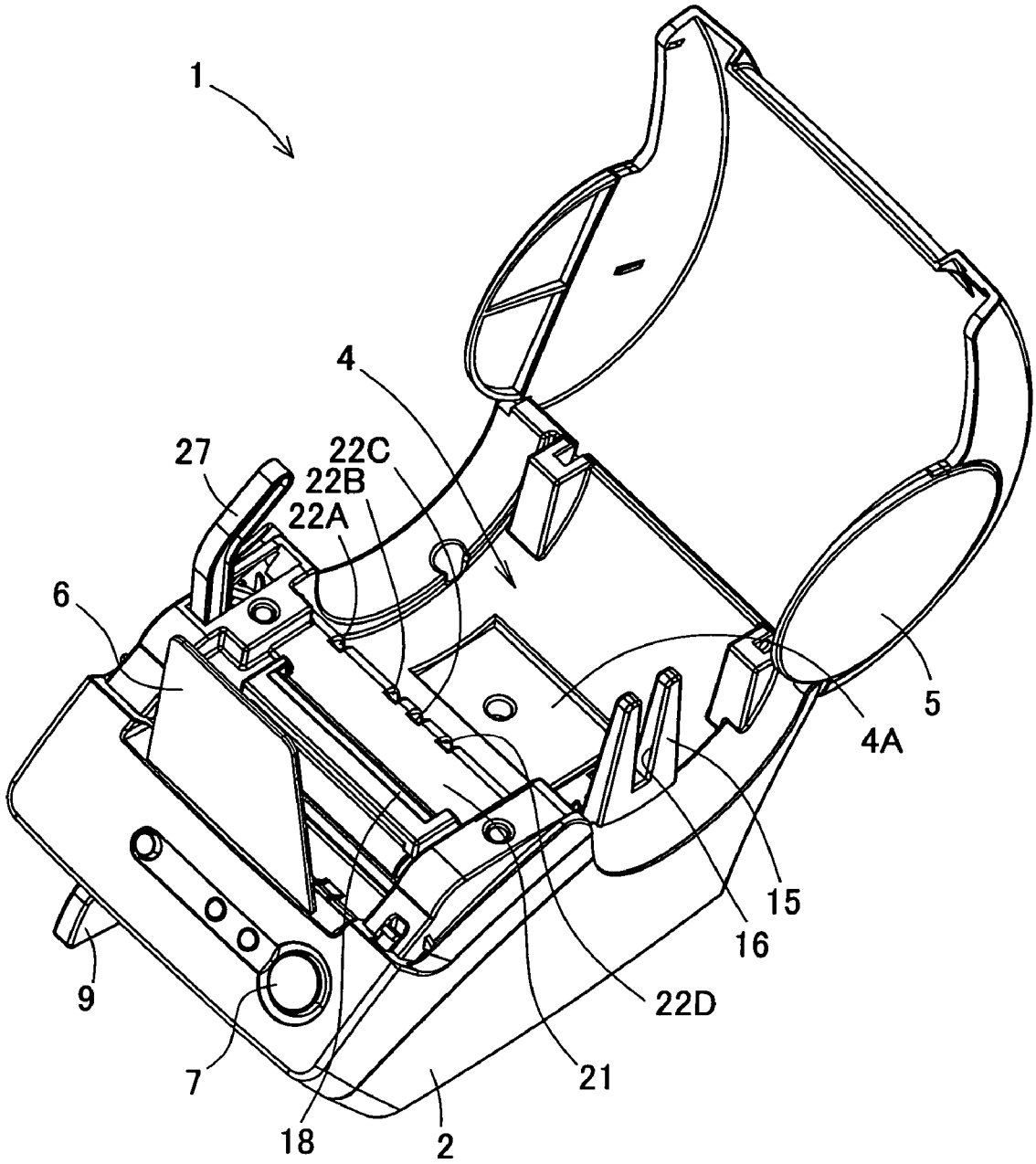
FIG. 5 is a schematic perspective view of the tape printer in the first embodiment with the top cover being opened.
Figure 6:
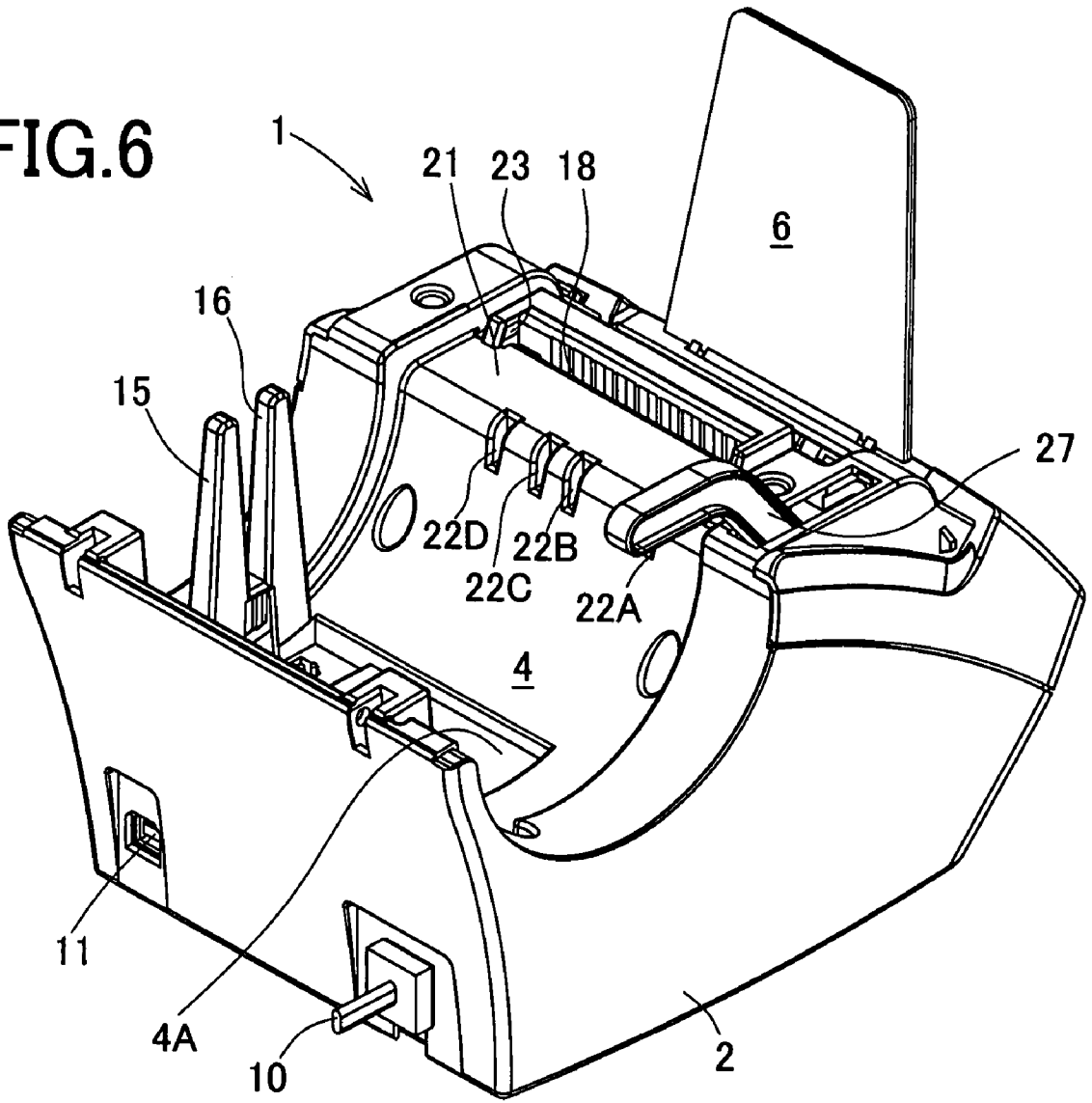
FIG. 6 is a schematic perspective back view of the tape printer in the first embodiment, from which the top cover is removed.
Figure 9A:
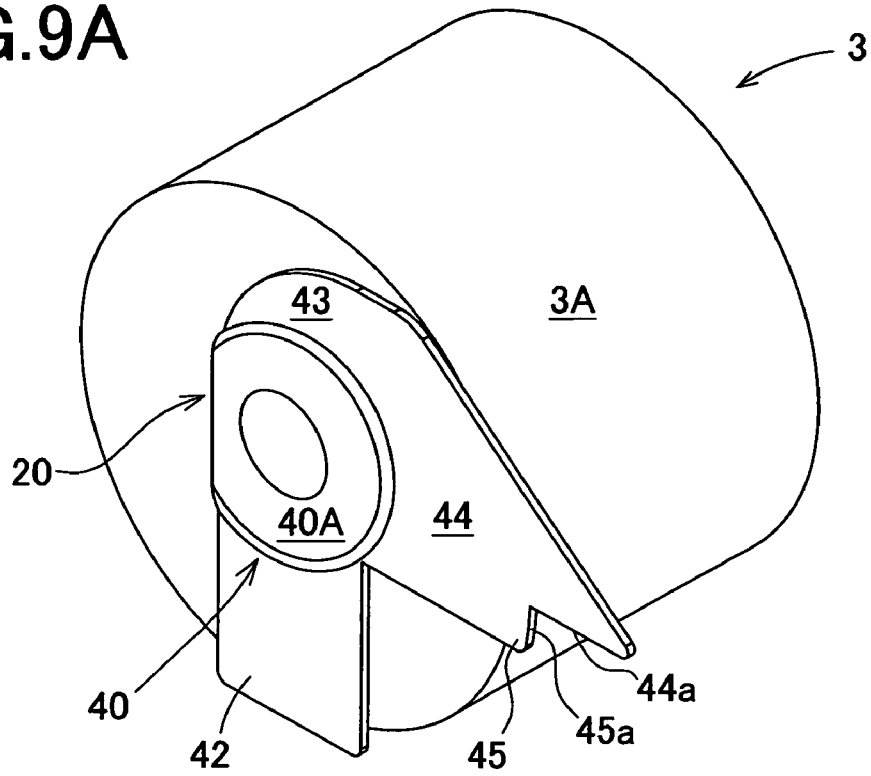
FIG. 9A is a perspective view of the roll sheet holder holding a roll sheet, seen from upper front.
Figure 9B:
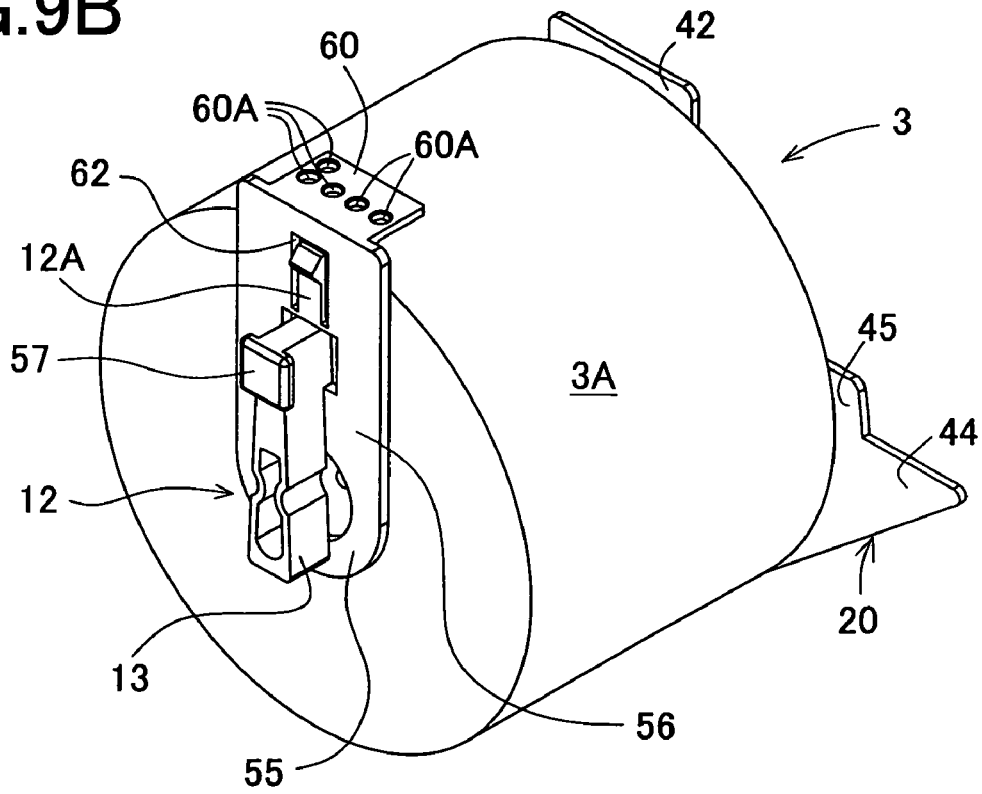
FIG. 9B is a perspective view of the roll sheet holder turned upside down from a state shown in FIG. 9A.

As shown in FIGS. 4 and 9, the roll sheet holder 3 is basically constructed of the roll sheet 3A wound around the sheet core 3B, the guide member 20, the holding member 12, and a holder shaft 40. Specifically, the guide member 20 has a first cylindrical part 38 which is inserted in one open end of the sheet core 3B of the roll sheet 3A so that the guide member 20 is set in contact with one end face of the roll sheet 3A. The positioning member 12 includes a second cylindrical part 39 which is inserted in the other open end of sheet core 3B so that the positioning member 12 is set in contact with the other end face of the roll sheet 3A. The holder shaft 40 has one end inserted in the first cylindrical part 38, the end being formed with a radially extended flange part 40A fixed on an outer end face of the first cylindrical part 38. The holder shaft 40 also has the other end inserted and fixed in the second cylindrical part 39 of the holding member 12. Accordingly, the holder shaft 40 may be selected from among a plurality of shafts of different lengths to easily provide many kinds of roll sheet holders 3 holding roll sheets 3A of different widths.

The guide member 20 further includes a first, second, third, and fourth extended portions 42, 43, 44, and 45. The first extended portion 42 is formed extending downward in a predetermined length from a lower periphery of the outer end face of the first cylindrical part 38. This first extended portion 42 is fitted in the positioning recess 4A formed in the bottom of the holder storage part 4 so that the lower end surface of the first extended portion 42 is brought in contact with the bottom surface of the positioning recess 4A. The second extended portion 43 is formed extending upward to cover a front quarter round of the end face of the roll sheet 3A. The third extended portion 44 is formed continuously extending from the second extended portion 43 up to near the insertion port 18 (see FIG. 6) and has an upper edge sloped downward to the front end. This third extended portion 44 further has a lower edge 44*a* extending horizontally, which is held in contact with the flat portion 21 of the tape printer 1 so that one side edge of the unwound part of the roll sheet 3A is guided along the inner surfaces of the second and third extended portions 43 and 44 up to the insertion port 18. The fourth extended portion 45 is formed under the third extended portion 44 between the rear end of the lower edge 44*a* at a predetermined distance from the front end and the first extended portion 42. When the lower edge 44*a* of the third extended portion 44 is held in contact with the placing portion 21, a front edge 45*a* of the fourth extended portion 45 is inserted in appropriate one of the second placing grooves 22A to 22D corresponding to the sheet width of the roll sheet 3A set in the sheet holder 3 (see FIG. 7).

The holder shaft 40 is provided with a slit 51 in the end portion fitted in the second cylindrical part 39 of the holding member 12. The slit 51 has a predetermined length along the longitudinal direction of the shaft 40 to engage a rib 50 formed protruding radially inward from the inner lower end of the second cylindrical part 39. Such engagement between the rib 50 of the holding member 12 and the slit 51 of the holder shaft 40 makes it possible to correctly position the holding member 12 and the guide member 20 with respect to each other through the holder shaft 40.

The first and second cylindrical parts 38 and 39 serve to rotatably support the sheet core 3B of the roll sheet 3A. The holder shaft 40 may be selected from among a plurality of shafts (four kinds in the first embodiment) of different lengths individually corresponding to the lengths of the sheet cores 3B.

The outer open end of the second cylindrical part 39 is closed by the positioning member 12. A flange 55 is formed around the second cylindrical part 39. An extended portion 56 is continuously formed under the flange 55. Respective inner surfaces of the flange 55 and the extended portion 56 are held in contact with the end face of the roll sheet 3A and the sheet core 3B. On the outer surfaces of the flange 55 and the extended portion 56, the longitudinal mounting piece 13 is provided protruding outward, at substantially the center of the width of the positioning member 12 in the feeding direction (a lateral direction in FIG. 9B). This mounting piece 13 is of a substantially rectangular section and has a vertical length in a direction substantially perpendicular to the central axis of the holder shaft 40 and a width which becomes smaller in a downward direction so that the mounting piece 13 is fitted in the first positioning groove 16 having a narrower width (in the feeding direction) towards the bottom of the holder support member 15 in the tape printer 1. The protruding distance of the mounting piece 13 is determined to be almost equal to the width (in a direction of the width of the tape printer 1, perpendicular to the feeding direction) of the first positioning groove 16.

The mounting piece 13 of the positioning member 12 is provided, on the lower outer surface, with a guide portion 57 of a square flat plate (about 1.5 mm to 3.0 mm in thickness in the first embodiment) having a larger width than the lower portion of the mounting piece 13 by a predetermined amount (about 1.5 mm to 3.0 mm in the first embodiment) at each side of the lower portion. Accordingly, to mount the roll sheet holder 3 in the tape printer 1, a user inserts the mounting piece 13 from above into the first positioning groove 16 by bringing an inner surface of the guide portion 57 into sliding contact with the outer surface of the holder support member 15. Thus, the roll sheet holder 3 can easily be fitted in place.

The positioning member 12 is designed to have the extended portion 56 extending downward (upward in FIG. 9B) longer by a predetermined length (about 1.0 mm to 2.5 mm in the first embodiment) than the lower end (the first extended portion 42) of the guide member 20. The positioning member 12 is also provided, at the lower end of the extended portion 56, with the sheet discrimination part 60 of a substantially rectangular shape extending inward by a predetermined length at almost right angle to the extended portion 56. As mentioned above, the sheet discrimination part 60 is formed with the sensor holes 60A arranged at predetermined positions corresponding to the sheet discrimination sensors S1 to S5 respectively. As shown in FIG. 8B, five sensor holes 60A are formed at predetermined positions corresponding to the kind of roll sheet 3A held in the sheet holder 3.

Further, the positioning member 12 is further formed with a longitudinally-extending rectangular through hole 62 in the extended portion 56 under the mounting piece 13. An elastic locking piece 12A is provided extending downward from the upper edge (an lower edge in FIG. 9B) of the through hole 62 and formed with an outward protrusion at a lower end (an upper end in FIG. 9B).

An explanation is given to a mounting manner of the roll sheet holder 3 constructed as above in the tape printer 1, referring to FIG. 2.

FIG. 2 shows the case where the roll sheet holder 3 holds the roll sheet 3A of a maximum width (e.g., about 66 mm) wound on the sheet core 3B. The mounting piece 13 of the holding member 12 of the holder 3 is first inserted from above into the positioning groove 16 of the holder support member 15. The holder 3 is put so that the lower edge 44*a* of the third extended portion 44 of the guide member 20 is brought into contact with the flat portion 21. The fourth extended portion 45 is engaged in the second positioning groove 22A formed at the rear corner of the flat portion 21 in the feeding direction. The first extended portion 42 of the guide member 20 is fitted in the positioning recess 4A of the holder storage part 4 so that the lower end face of the first extended portion 42 is brought into contact with the bottom surface of the positioning recess 4A. Simultaneously, the sheet discrimination part 60 is fitted in the discrimination recess 4B formed at a position inwardly adjacent to the base end of the holder support member 15 and the elastic locking piece 12A is engaged in the recess 15A formed in the base end of the holder support member 15. Thus, the roll sheet holder 3 is mounted in the holder storage part 4 to be freely removable therefrom.

While the lever 27 is in an up position, a part of the roll sheet 3A is drawn (unwound) and the leading end of the unwound part of the roll sheet 3A is inserted in the insertion port 18. During this time, one side edge of the unwound part of the roll sheet 3A is guided in contact with the inner surface of the guide member 20 and the other side edge is guided in contact with the protruding guide rib 23 provided on the side end of the insertion port 18. Thereafter, the lever 27 is turned down. The side edge of the inserted portion of the roll sheet 3A in contact with the guide rib 23 in the insertion port 18 is thus positioned in a reference point 72 (see FIG. 12). The leading end of the roll sheet 3A is then pressed against the platen roller 26 by the thermal head 31, bringing the roll sheet 3A into a printable state.

FIG. 2B shows the case where the roll sheet holder 3 holds the roll sheet 3A of a width (e.g., about 32 mm) about half the maximum width, wound on the sheet core 3B. Similarly, the mounting piece 13 of the holding member 12 of the holder 3 is first inserted from above into the positioning groove 16 of the holder support member 15. The sheet holder 3 is put so that the lower edge 44*a* of the third extended portion 44 of the guide member 20 is brought into contact with the flat portion 21. The fourth extended portion 45 is engaged in the second positioning groove 22C formed at the rear corner of the flat portion 21 in the feeding direction. The first extended portion 42 of the guide member 20 is fitted in the positioning recess 4A of the holder storage part 4 so that the lower end face of the first extended portion 42 is brought into contact with the bottom surface of the positioning recess 4A. Simultaneously, the sheet discrimination part 60 is fitted in the discrimination recess inwardly adjacent to the base end of the holder support member 15 and the elastic locking piece 12A is engaged in the recess 15A formed in the base end of the holder support member 15. Thus, the roll sheet holder 3 is mounted in the holder storage part 4 to be freely removable therefrom.

While the lever 27 is in an up position, a part of the roll sheet 3A is drawn (unwound) and the leading end of the unwound part of the roll sheet 3A is inserted in the insertion port 18. During this time, one side edge of the unwound part of the roll sheet 3A is guided in contact with the inner surface of the guide member 20 and the other side edge is guided in contact with the guide rib 23 provided on the side end of the insertion opening 18. Thereafter, the lever 27 is turned down. The side edge of the inserted portion of the roll sheet 3A in contact with the guide rib 23 in the insertion port 18 is thus positioned in the reference point 72 (see FIG. 12). The leading end of the roll sheet 3A is then pressed against the platen roller 26 by the thermal head 31, bringing the roll sheet 3A into a printable state.

In either of the above cases where the roll sheet holder 3 holds the roll sheet 3A of the maximum width wound around the sheet core 3B as shown in FIG. 2A or the roll sheet holder 3 holds the roll sheet 3A of the half width of the maximum width wound around the sheet core 3B as shown in FIG. 2B, the side edge of any roll sheet 3A on the holding member 12 side is positioned in contact with the guide rib 23 in the insertion port 18. This applies to the case where the roll sheet holder 3 holds the roll sheet 3A of a minimum width wound around the sheet core 3B. In other words, when the roll sheet holder 3 is set in the holder storage part 4, the part of the roll sheet 3A is inserted in the insertion port 18 so that the side edge of any roll sheet 3A inevitably comes into contact with the guide rib 23, regardless of the width of the roll sheet 3A. The inserted part of the roll sheet 3A in this state is fed toward the thermal head 31. It is to be noted that the maximum width of the roll sheet 3A is determined to be substantially equal to the length of the thermal head 31.

Next, a printing unit containing the thermal head 31, the platen roller 26, and others is explained with its peripheral components, referring to FIGS. 10 to 14.

Figure 10:
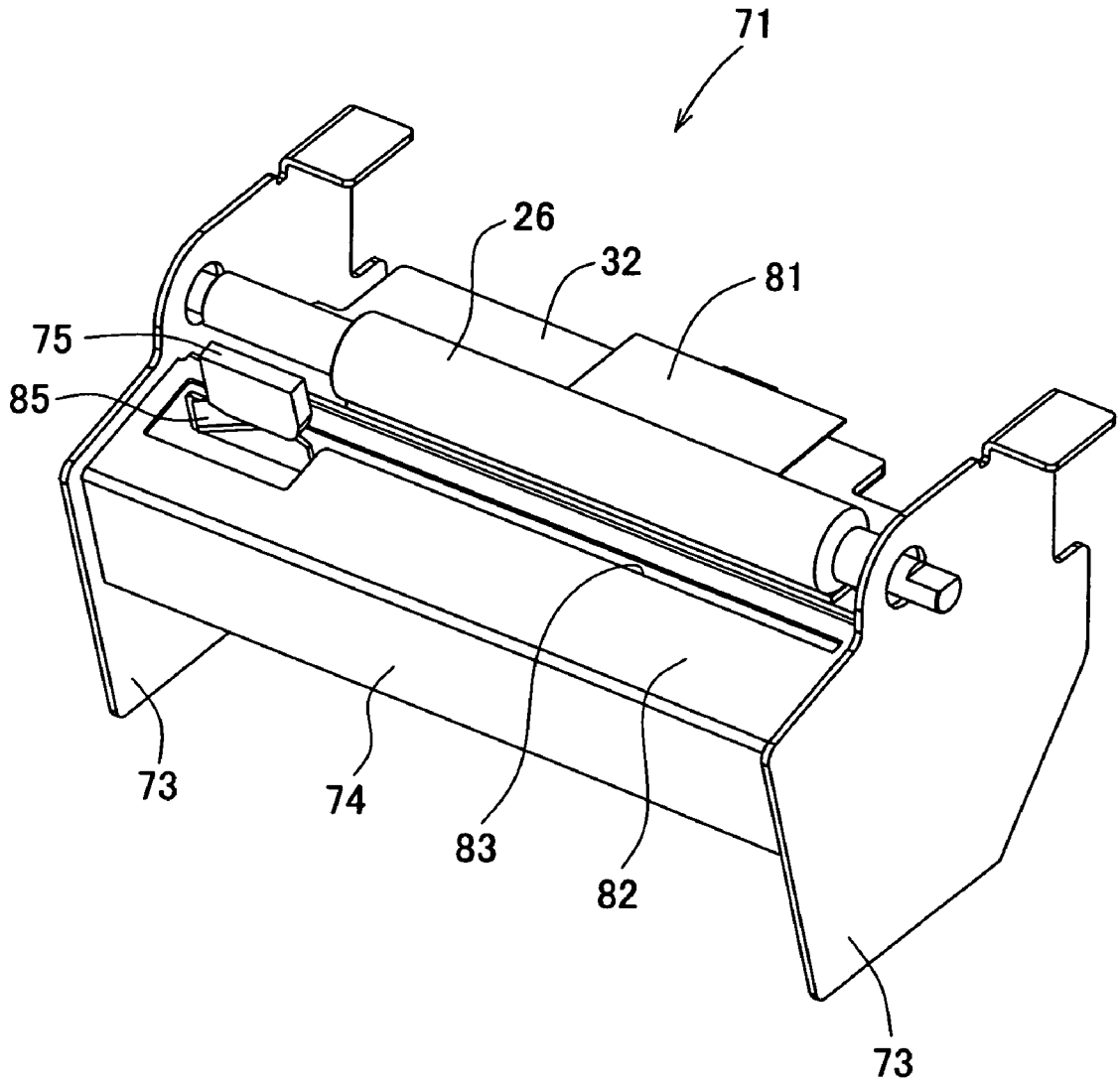
FIG. 10 is a perspective view of a printing unit and its peripheral components in the tape printer in the first embodiment.
Figure 11:
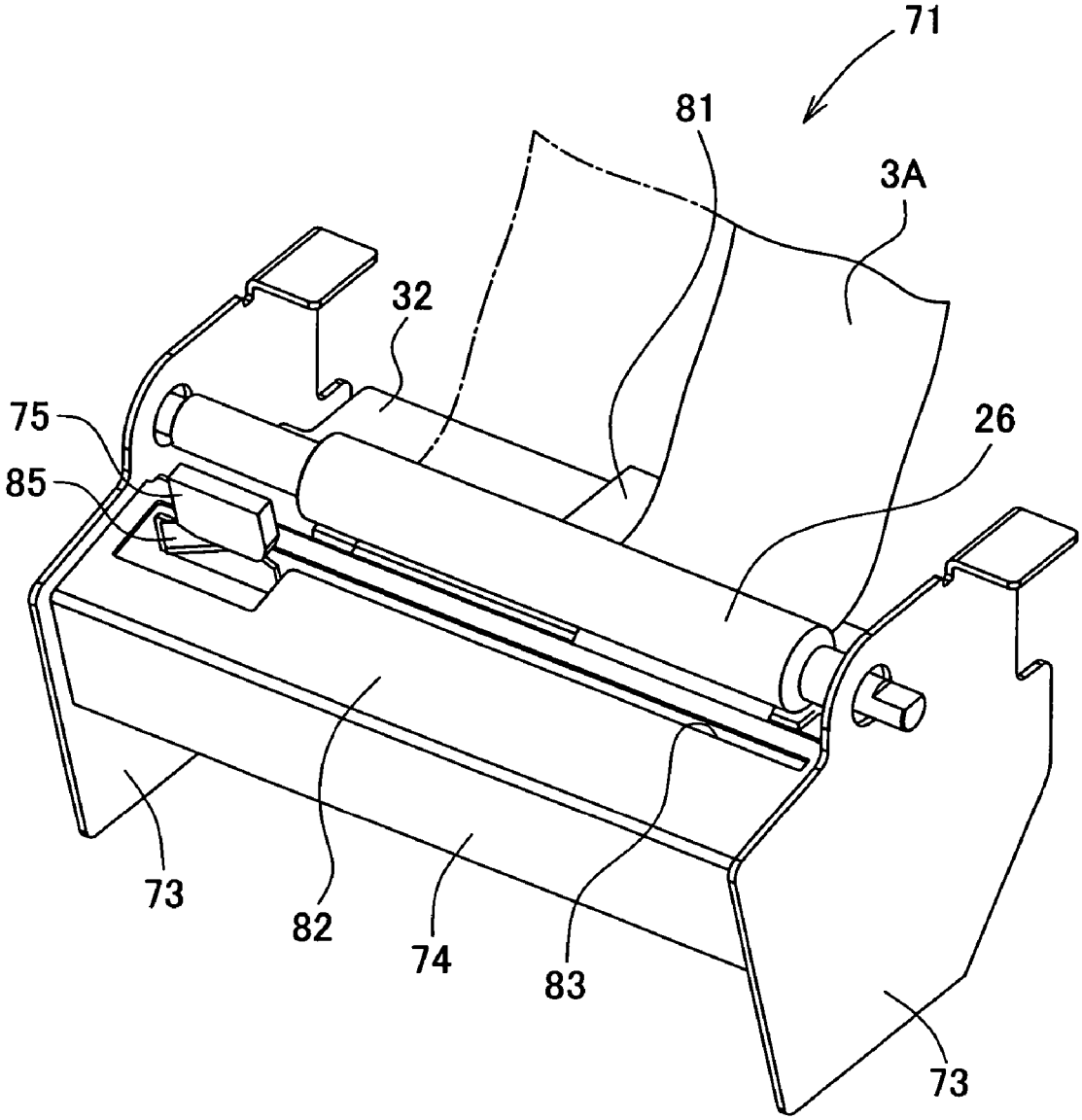
FIG. 11 is a perspective view of the printing unit and its peripheral components in FIG. 10, in which the thermal head is separated from the platen roller and a part of the roll sheet is inserted in an insertion port.
Figure 12:
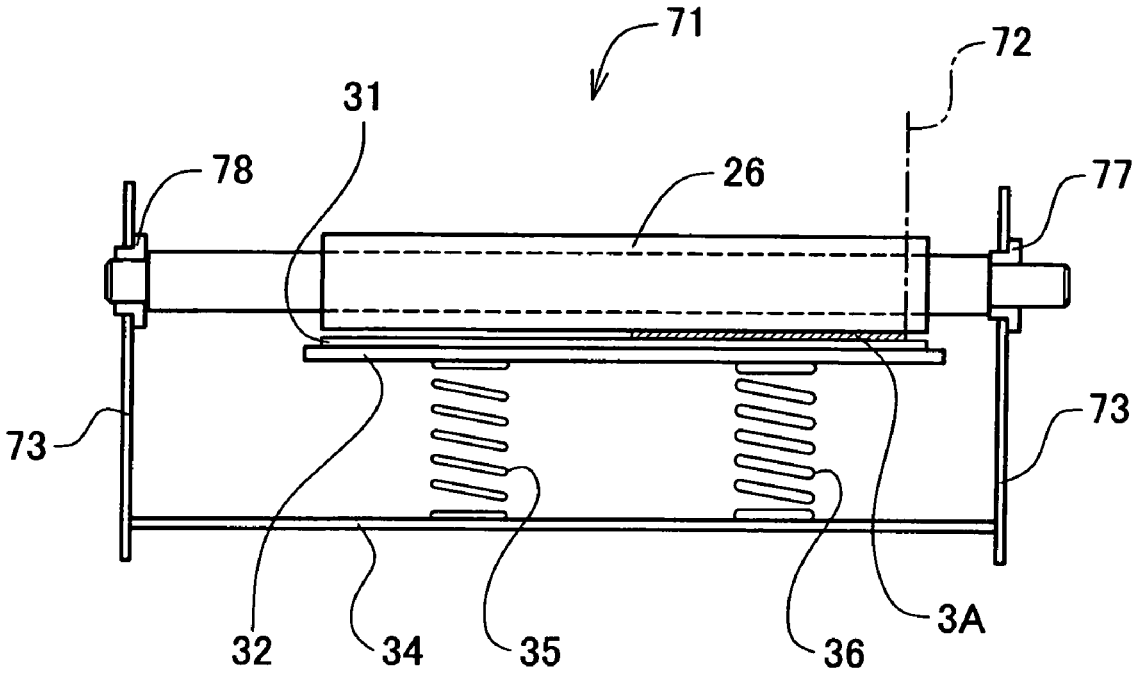
FIG. 12 is a sectional view of main parts of the printing unit in which the roll sheet having the width about half the maximum width is mounted.

As shown in FIGS. 10 to 12, a printing unit 71 includes a frame 34 having a pair of side walls 73. Provided between the side walls 73 are the platen roller 26, the head support member 32 serving as a thermal radiation plate, a cutter plate 74, and a cutter holder 75.

This platen roller 26 is rotatably supported on the side walls 73 through respective bearings 77 and 78. The platen roller 26 is driven by the stepping motor or the like not shown to rotate as mentioned above. The thermal head 31, an FPC substrate 81 of the thermal head 31, and others are fixedly mounted on an upper surface of the head support member 32 facing to the platen roller 26. Further, the cutter plate 74 is formed, in an upper surface, namely, a feeding surface 82 on which the roll sheet 3A is slidable, with a passing slot 83 formed in parallel with the platen roller 26. In the passing slot 83, the cutter holder 75 is reciprocally moved. The cutter holder 75 is provided with a movable blade 85 vertically extending through the passing slot 83 for cutting the roll sheet 3A.

As shown in FIGS. 8, 12, and 13, a rear edge of the head support member 32 in the feeding direction is supported by a back portion of the frame 34 so that the head support member 32 vertically swings about the rear edge. Each coil spring 35 and 36 which presses the thermal head 31 against the peripheral surface of the platen roller 26 is disposed between the bottom face of the frame 34 and a back side of the head support member 32 facing to the thermal head 31. The springs 35 and 36 are arranged in line along the longitudinal direction of the thermal head 31 and placed respectively at a position to divide substantially equally each length from a longitudinal center of the thermal head 31 to each end in a width direction.

Figure 13A:
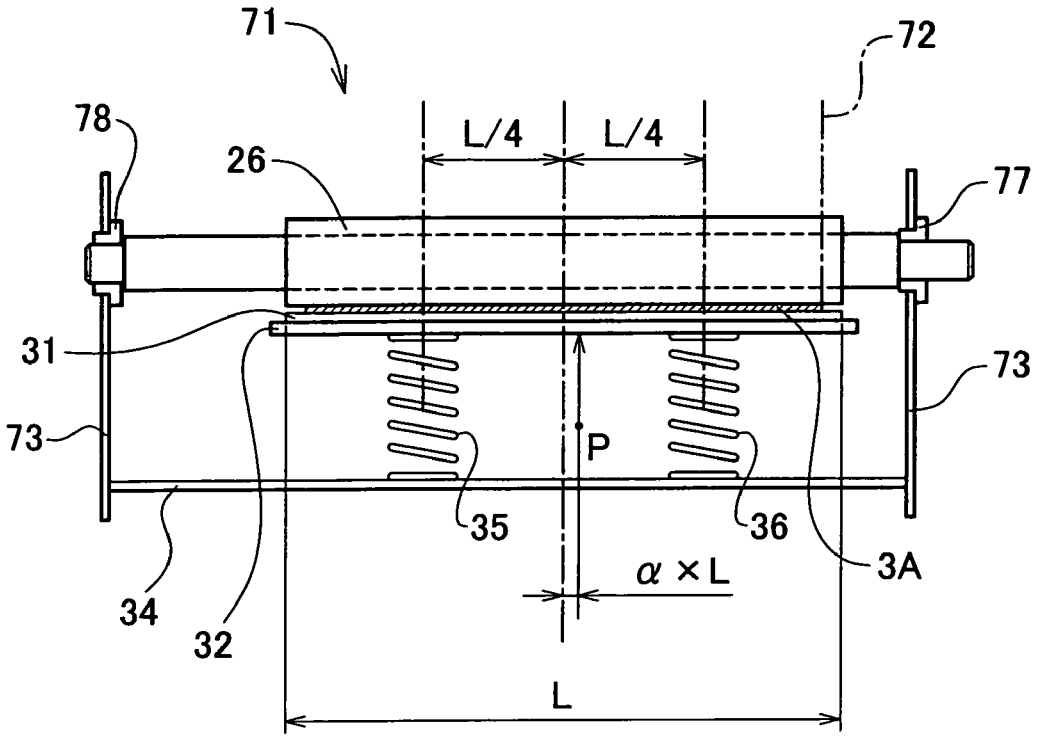
FIG. 13A is an explanatory view showing a positional relationship of a resultant force in relation to a load distribution of the thermal head.

As shown in FIG. 13A, the resultant force resulting from the force of the coil spring 36 placed closer to the reference point 72 through which the side edge of the roll sheet 3A on the holding member 12 side passes and the force of the coil spring 35 placed closer to the other side edge of the roll sheet 3A acts on a position P. This resultant force acting position P is displaced from the longitudinal center of the thermal head 31 toward the reference point 72 by a distance ($\alpha \times L$) obtained by multiplying the length L of the thermal head 31 by a coefficient $\alpha$ ($\alpha$=0.004 to 0.0029 in the first embodiment). Accordingly, as shown in FIG. 13B, the distribution of loads of the coil springs 35 and 36 on the thermal head 31 is set such that the load on the reference point 72 side, that is, on the right portion of thermal head 31 in the FIG. 13A, is larger than the load on the left portion of the thermal head 31.

As shown in FIGS. 11 and 12, accordingly, while the lever 27 is held in an up position, the roll sheet 3A is drawn (unwound) and the leading end thereof is inserted in the insertion port 18. At this time, the side edge of the unwound part of the roll sheet 3A on the holding member 12 side is guided in contact with the guide rib 23 in the insertion port 18. Consequently, the side edge of the roll sheet 3A on the holding member 12 side is positioned in the reference point 72. The roll sheet 3A, regardless of width, can be set so that the side edge is always positioned in the reference point 72.

When the lever 27 is turned down, the leading end of the roll sheet 3A is pressed against the platen roller 26 while the side edge of the roll sheet 3A on the holding member 12 side is positioned in the reference point 72. Thus, the roll sheet 3A is in a printable state. If the roll sheet 3A of the width about half the maximum width is used, the loading position of the coil spring 36 closer to the reference point 72 corresponds to a substantial center of the roll sheet 3A in the width direction. Thus, the thermal head 31 is brought into contact with the entire part of the roll sheet 3A under almost uniform pressure.

Figure 13B:
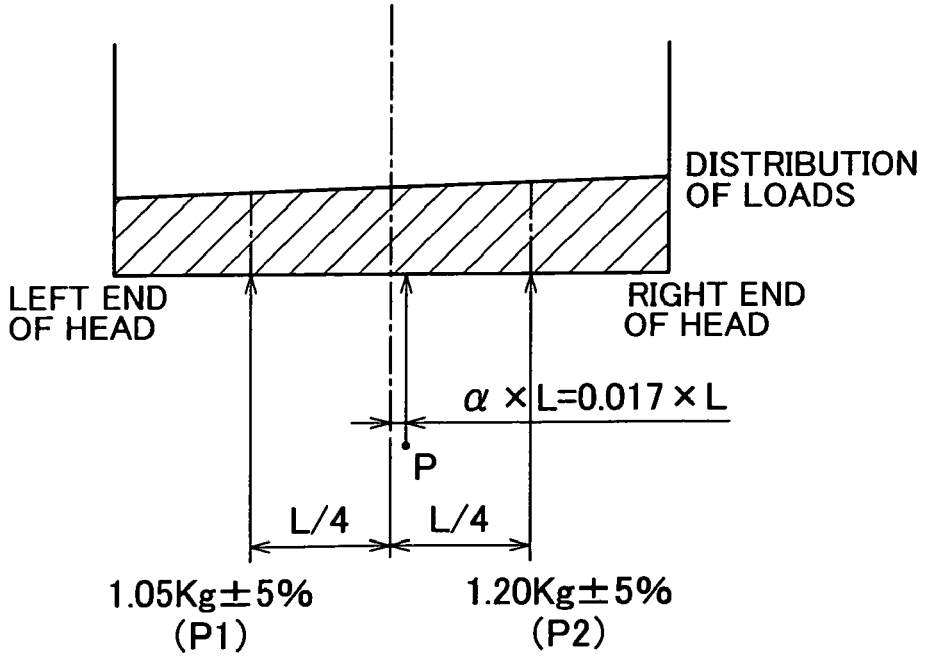
FIG. 13B is an explanatory view showing the load distribution of the thermal head.

As shown in FIG. 13B, assuming that the spring load of the coil spring 36 is P2 and the spring load of the coil spring 35 is P1, the following expression is set according to the balance of moment:

$$(L/4+\alpha\times L)\times P1=(L/4-\alpha\times L)\times P2$$

According to this expression, assuming that for example P1=1.05 kgf and P2=1.20 kgf, $\alpha$=0.017. Assuming that variations in spring load of each coil spring 35 and 36 is ±5%, i.e., P1=1.05 kgf±5% and P2=1.20 kgf±5%, the coefficient $\alpha$ is 0.004 to 0.029.

Herein, referring to FIG. 14, explanations are made on print results about the roll sheet 3A of the width about half the maximum width (see FIG. 12) obtained when the spring loads P1 and P2 of the coil springs 35 and 36 are changed to change the coefficient $\alpha$, that is, the resultant force acting position P on which the resultant force of the coil springs 35 and 36 acts.

FIG. 14 is a table 79 showing print results including "$\alpha$ value" representing the coefficient $\alpha$ and "Print result" showing each print result for each "$\alpha$ value". The print results obtained when the spring loads of the coil springs 35 and 36 are changed to change the coefficient $\alpha$ are as follows.

In the roll sheet 3A of the width about half the maximum width, there occurred faint prints on the side edge portion of the roll sheet 3A near the reference point 72 for the coefficient α smaller than 0.004. The print result for the coefficient α in a range of 0.004 to 0.029 was good. Further, in the roll sheet 3A of the width about half the maximum width, there occurred faint prints on the other side edge portion of the roll sheet 3A farther from the reference point 72 for the coefficient α larger than 0.029.

Herein, the coil springs 35 and 36 correspond to a plurality of elastic members of the invention. The roll sheet holder 3, holder support member 35, platen roller 26, and thermal head 31 constitute a feeding mechanism of the invention.

In the tape printer 1 in the first embodiment, as explained above, the plate roller 26 is rotatably supported on the pair of side walls 73 of the frame 34 and the thermal head 31 mounted on the head support member 32 is pressed against the peripheral surface of the platen roller 26 by the coil springs 35 and 36. The part of the long roll sheet 3A set in a wound state in the roll sheet holder 3 removably mounted in the printer 1 is inserted in the insertion port 18 so that the part of the roll sheet 3A is fed with one side edge being positioned in the reference point 72 of the thermal head 31, and then subjected to printing by the thermal head 31. Each coil spring 35 and 36 is disposed at the position to divide substantially equally each length from the center to each end of the thermal head 31 in the longitudinal direction.

The distribution of loads of the coil springs 35 and 36 on the thermal head 31 is determined so that the load on the thermal head 31 on the reference point 72 side is larger than the load on the other side. The resultant force acting position P on which the resultant force of the coil springs 35 and 36 act is displaced from the center of the thermal head 31 in the longitudinal direction toward the reference point 72 by the distance (α×L) obtained by multiplying the entire length L of the thermal head 31 by a coefficient α (α=0.004 to 0.0029 in the first embodiment).

Accordingly, even when the roll sheet 3A of the width about half the maximum width, namely, the roll sheet 3A of the width corresponding to half the length of the thermal head 31 is fed with the side edge being positioned in the reference point 72, the thermal head 31 can be pressed against the entire roll sheet 3A under substantial uniform pressure. This makes it possible to enhance the printing accuracy and the feeding accuracy, thereby printing with high quality. The spring load of each coil spring 35 and 36 is determined so that the coefficient α is 0.004 to 0.029. Thus, even a simple structure can print with good quality without needing a positional change of the coil springs 35 and 36, which results in a reduction in production cost. Further, the thermal head 31 can surely be brought into contact under almost uniform pressure with the roll sheet 3A of the width corresponding to about half the length of the thermal head 31. This makes it possible to surely prevent faint prints on both side edge portions of the roll sheet 3A. For the roll sheet 3A of the width about half the maximum width, the load of the coil spring 36 closer to the reference point 72 acts on the substantial center of the roll sheet 3A in the width direction. Accordingly, the thermal head 31 can surely be brought in contact under almost uniform pressure with the entire roll sheet 3A.

Second Embodiment

Next, a second embodiment of the tape printer will be described with reference to FIG. 15. The same numerals as those in the first embodiment shown in FIGS. 1 to 14 indicate similar or identical components or elements of the tape printer 1 in the first embodiment.

A schematic structure and control structure of the tape printer in the second embodiment are substantially the same as those in the tape printer in the first embodiment, except for a structure of a printing unit of the tape printer in the second embodiment differing from the structure of the printing unit 71 of the tape printer 1 in the first embodiment.

The structure of the printing unit of the tape printer in the second embodiment will be explained below with reference to FIG. 15.

Figure 15:
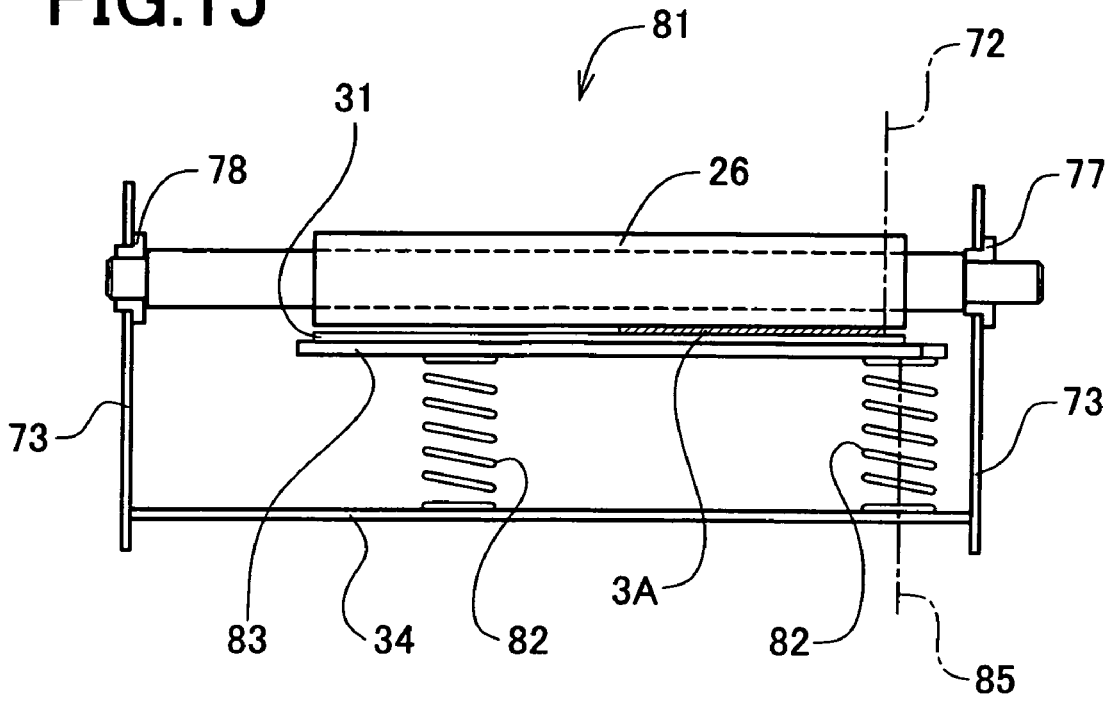
FIG. 15 is a sectional view of main parts of a printing unit in a tape printer in a second embodiment, in which the roll sheet having the width about half the maximum width is mounted.

As shown in FIG. 15, the printing unit 81 of the tape printer in the second embodiment has substantially the same structure as the printing unit 71 of the tape printer 1 in the first embodiment. The printing unit 81 differs from the printing unit 71 in only the use of coil springs 82 instead of the coil springs 35 and 36. The coil springs 82 have almost the same pressing forces; for example, the pressing force of each coil spring 82 for the thermal head 31 having a length of about 70 mm is 1150 gf ±5%.

A head support member 83 mounting thereon the thermal head 31 has substantially the same structure as the head support member of the printing unit 71 in the first embodiment. However, the head support member 83 has an end (a right end) on a reference point 72 side extending outward (rightward in FIG. 15) in its longitudinal direction. The coil spring 82 disposed closer to the reference point 72, i.e., the right coil spring 82 in FIG. 15, is placed so that a loading position 85 is outside the reference point 72 (at a distance about 1 mm to 6 mm outward from the reference point 72 in the second embodiment). The coil spring 82 disposed farther from the reference point 72, i.e., the left coil spring 82 in FIG. 15, is placed at a position dividing substantially equally the length from a center of the thermal head 31 in the longitudinal direction to the end (the left end) of the thermal head 31 far from the reference point 72.

While the lever 27 is in an up position, the roll sheet 3A is unwound and the leading end is inserted in the insertion port 18 so that the side edge (the right edge in FIG. 15) of the unwound part of the roll sheet 3A on the holding member 12 side is guided in contact with the guide rib 23 in the insertion port 18. Thus, the side edge of the roll sheet 3A on the holding member 12 side is positioned in the reference point 72. In other words, regardless of the width of the roll sheet 3A set in the roll sheet holder 3, the side edge of the roll sheet 3A on the holding member 12 side will be always positioned in the reference point 72.

When the lever 27 is turned down, subsequently, the leading end of the roll sheet 3A is pressed against the platen roller 26 by the thermal head 31 while the side edge of the roll sheet 3A is positioned in the reference point 72. The printer is thus in a printing enabled state. In the case of using the roll sheet 3A having a width about half the maximum width, the loading position 85 of the coil spring 82 closer to the reference point 72 is outside the side edge of the roll sheet 3A in its width direction. Accordingly, the thermal head 31 can be brought into the roll sheet 3A under almost uniform pressure.

Herein, the coil springs 82 correspond to a plurality of elastic members of the invention. The roll sheet holder 3, holder support member 15, platen roller 26, and thermal head 31 correspond to a feeding mechanism of the invention.

As described in detail as above, in the tape printer in the second embodiment, the platen roller 26 is rotatably supported on the pair of side walls 73 of the frame 34, and the thermal head 31 mounted on the head support member 83 is pressed against the peripheral surface of the platen roller 26 by the coil springs 82 having substantially the same pressing forces.

The long roll sheet 3A set in a wound state in the roll sheet holder 3 which is removably mounted in the tape printer is unwound so that the side edge is positioned in the reference point 72 and the leading end is inserted in the insertion port 18, and then a printing surface is subjected to printing by the thermal head 31. The coil spring 82 closer to the reference point 72 is placed so that the loading position 85 is outside the reference point 72 in the longitudinal direction of the thermal head 31. The coil spring 82 farther from the reference point 72 is placed at the position dividing substantially equally the length from the center of the thermal head 31 in the longitudinal direction to the end of the thermal head 31 far from the reference point 72.

Accordingly, even when the roll sheet 3A having the width about half the maximum width, that is, about half the entire length of the thermal head 31 is unwound so that the part of the roll sheet 3A is fed with its side edge being positioned in the reference point 72. The thermal head 31 can surely be brought into contact with the roll sheet 3A under almost uniform pressure by the coil springs 82; one is placed closer to the reference point 72 so that its loading position 85 is outside the reference point 72 in the longitudinal direction of the thermal head 31 and the other is placed at the position dividing substantially equally the length from the center of the thermal head 31 in the longitudinal direction to the end of the thermal head 31 far from the reference point 72. Consequently, the printing accuracy and the feeding accuracy can be enhanced to print with high quality. It is further possible to use the coil springs 82 produced under the same standard, thus achieving a reduction in production cost. The pressing forces of the coil springs 82 can be made substantially equal to the pressing force of a conventional spring. Accordingly, a frictional force between the peripheral surface of the platen roller 26 and the thermal head 31 can be reduced to prevent skew feeding of the roll sheet 3A and reduce load on a motor.

Third Embodiment

A third embodiment of the tape printer will be explained below with reference to FIG. 16. The same numerals as those in the first and second embodiments shown in FIGS. 1 to 15 indicate similar or identical components or elements of the tape printer 1 in the first embodiment.

A schematic structure and control structure of the tape printer in the third embodiment are substantially the same as those in the tape printer in the second embodiment, except for a structure of a printing unit of the tape printer in the third embodiment differing as mentioned later from the structure of the printing unit 81 of the tape printer in the second embodiment.

The structure of the printing unit of the tape printer in the third embodiment will be explained below with reference to FIG. 16.

Figure 16:
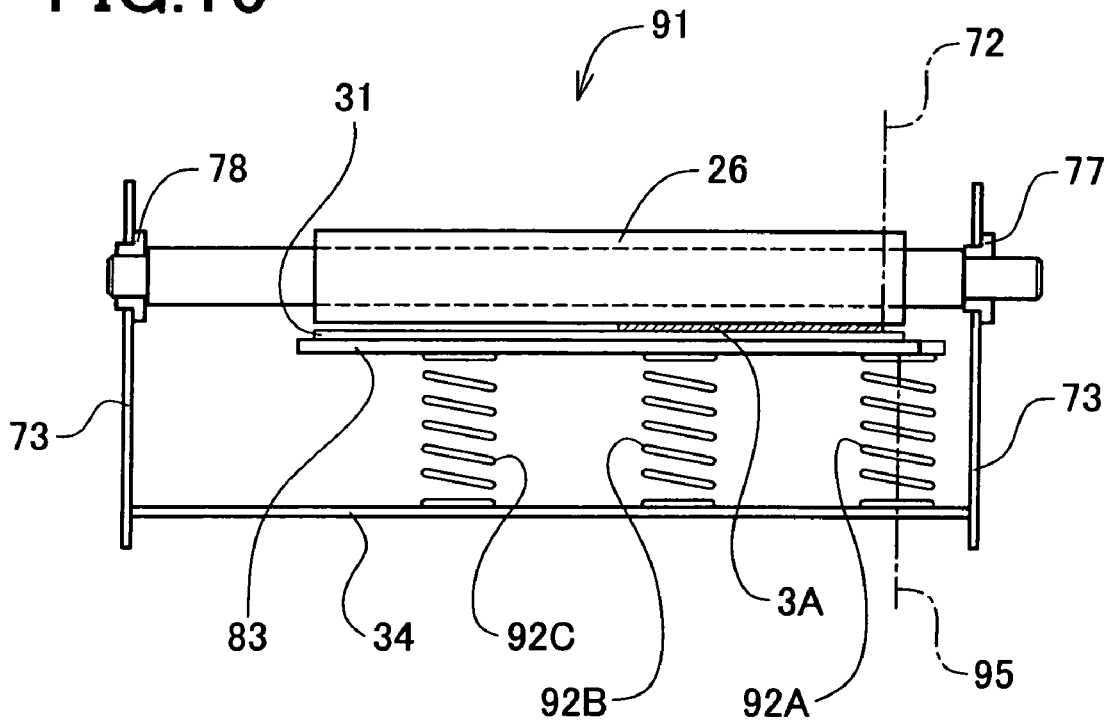
FIG. 16 is a sectional view of main parts of a printing unit in a tape printer in a third embodiment, in which the roll sheet having the width about half the maximum width is mounted.
Figure 17A:
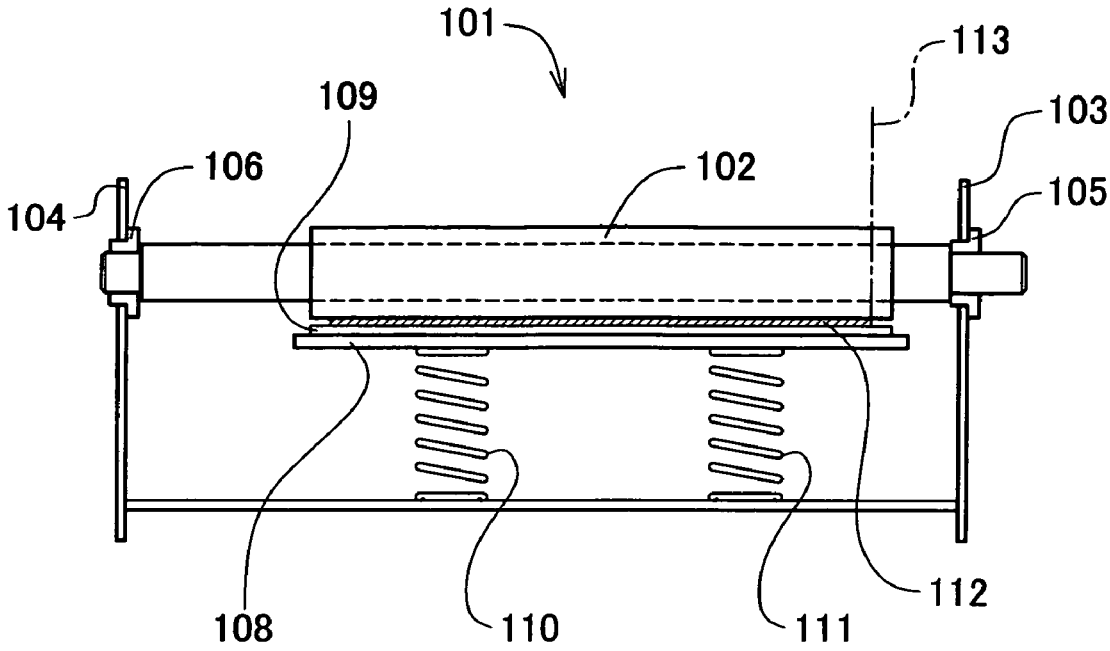
FIG.17A PRIOR ART
FIG. 17A is a sectional view of main parts of a printing unit in a conventional tape printer in which a roll sheet of a maximum width is mounted.
Figure 17B:
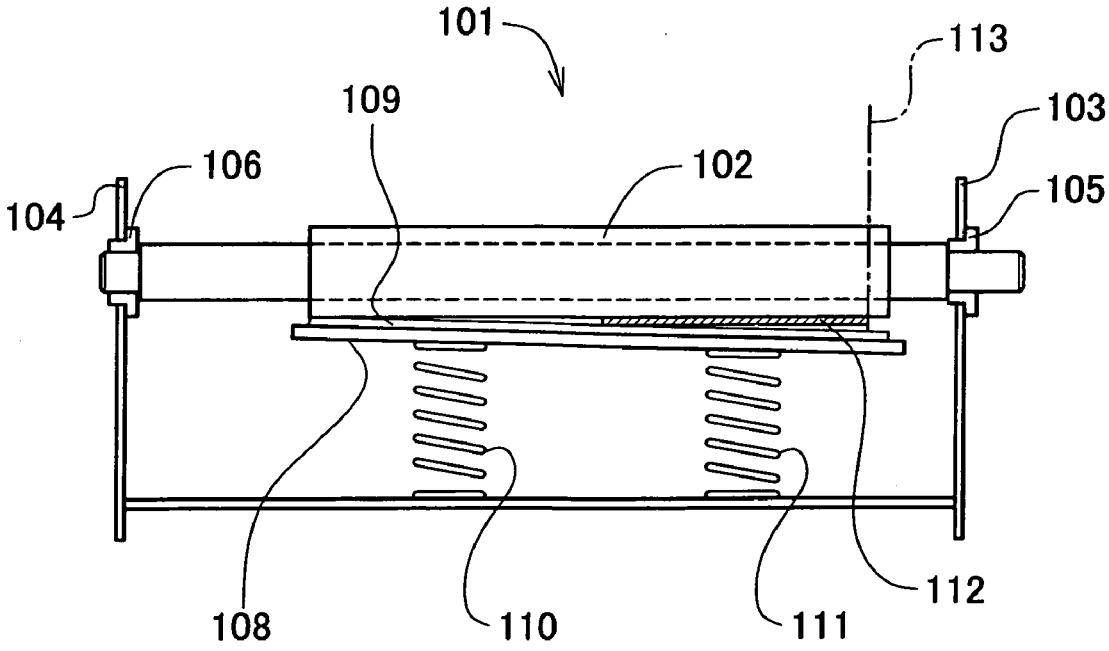
FIG.17B PRIOR ART
FIG. 17B is a sectional view of main parts of the printing unit of FIG. 17A, in which a roll sheet of a width about half the maximum width is mounted.

As shown in FIG. 16, the printing unit 91 of the tape printer in the third embodiment has substantially the same structure as the printing unit 81 of the tape printer in the second embodiment. The printing unit 91 differs from the printing unit 81 in only the use of coil springs 92A to 92C instead of the coil springs 82. The coil springs 92A to 92C have almost the same pressing forces; for example, each pressing force for the thermal head 31 having a length of about 70 mm is 767 gf±5%.

The coil spring 92A disposed closest to the reference point 72, i.e., the right coil spring 92A in FIG. 16, is placed so that a loading position 95 is outside the reference point 72 (at a distance about 1 mm to 6 mm outward from the reference point 72 in the third embodiment). The coil spring 92C disposed farthest from the reference point 72, i.e., the left coil spring 92C in FIG. 16, is placed at a position dividing substantially equally the length from a center of the thermal head 31 in the longitudinal direction to the end (the left end) of the thermal head 31 far from the reference pint 72. Further, the coil spring 92B is placed at an intermediate position between the coil springs 92A and 92C. Those coil springs 92A to 92C are arranged as above at substantially equally intervals along the longitudinal direction of the thermal head 31.

While the lever 27 is in an up position, the roll sheet 3A is unwound and the leading end is inserted in the insertion port 18 so that the side edge (the right edge in FIG. 16) of the unwound part of the roll sheet 3A on the holding member 12 side is guided in contact with the guide rib 23 in the insertion port 18. Thus, the side edge of the roll sheet 3A on the holding member 12 side is positioned in the reference point 72. In other words, regardless of the width of the roll sheet 3A set in the roll sheet holder 3, the side edge of the roll sheet 3A on the holding member 12 side will be always positioned in the reference point 72.

When the lever 27 is turned down, subsequently, the leading end of the roll sheet 3A is pressed against the platen roller 26 by the thermal head 31 while the side edge of the roll sheet 3A is positioned in the reference point 72. The printer is thus in a printing enabled state. In the case of using the roll sheet 3A having a width about half the maximum width, the loading position 95 of the coil spring 92A closest to the reference point 72 is outside the side edge of the roll sheet 3A in its width direction and the coil spring 92B disposed between the coil springs 92A and 92C is placed close to and inside the side edge the roll sheet 3A in the width direction. Accordingly, the thermal head 31 can be brought into contact with the roll sheet 3A under almost uniform pressure.

Herein, the coil springs 92A to 92C correspond to a plurality of elastic members of the invention. The roll sheet holder 3, holder support member 15, platen roller 26, and thermal head 31 correspond to a feeding mechanism of the invention.

As described in detail as above, in the tape printer in the third embodiment, the platen roller 26 is rotatably supported on the pair of side walls 73 of the frame 34, and the thermal head 31 held on the head support member 83 is pressed against the peripheral surface of the platen roller 26 by the coil springs 92A to 92C having substantially the same pressing forces. The long roll sheet 3A set in a wound state in the roll sheet holder 3 which is removably mounted in the tape printer is unwound so that the side edge is positioned in the reference point 72 and the leading end is inserted in the insertion port 18, and then a printing surface is subjected to printing by the thermal head 31. The coil spring 92A closest to the reference point 72 is placed so that the loading position 95 is outside the reference point 72 in the longitudinal direction of the thermal head 31. The coil spring 92C farthest from the reference point 72 is placed at the position dividing substantially equally the length from the center of the thermal head 31 in the longitudinal direction to the end of the thermal head 31 far from the reference point 72. The coil spring 92B is placed at the intermediate position between the coil springs 92A and 92C.

Accordingly, even when the roll sheet 3A having the width about half the maximum width, that is, about half the entire length of the thermal head 31 is unwound so that the part of the roll sheet 3A is fed with its side edge being positioned in the reference point 72. The thermal head 31 can surely be brought in the roll sheet 3A under almost uniform pressure by the coil springs 92A to 92C. Specifically, the coil spring 92A is placed closest to the reference point 72 so that its loading position 85 is outside the reference point 72 in the longitudinal direction of the thermal head 31, the coil spring 92C is placed at the position dividing substantially equally the length from the center of the thermal head 31 in the longitudinal direction to the end of the thermal head 31 far from the reference point 72, and the coil spring 92B is placed at the intermediate position between the coil springs 92A and 92C. Consequently, the printing accuracy and the feeding accuracy can be enhanced to achieve high quality printing. It is further possible to use the coil springs 92A to 92C produced under the same standard, thus achieving a reduction in production cost. The resultant force of the coil springs 92A to 92C can be made substantially equal to the pressing force of a conventional spring. Accordingly, a frictional force between the peripheral surface of the platen roller 26 and the thermal head 31 can be reduced to prevent skew feeding of the roll sheet 3A and reduce load on a motor.

The present invention may be embodied in other specific forms without departing from the spirit or essential characteristics thereof.

For instance, in the printing units 81 and 91 in the second and third embodiments, the coil springs 82 and 92 are placed at the position dividing substantially equally the length from the center of the thermal head 31 in the longitudinal direction to the end of the thermal head 31 far from the reference point 72. Each coil spring 82 and 92 may be placed at a position inside the end of the thermal head 31.

The printing units 71, 82, and 91 in the first, second, and third embodiments are structured such that each coil spring 35, 36, 82, 92A to 92C is disposed between the head support member 32 and the bottom face of the frame 34 to press the head support member 32 toward the platen roller 26. Alternatively, an elastic member such as a coil spring may be placed to pull up the head support member toward the platen roller 26. This makes it possible to lower the height of the frame 34, thereby reducing the thickness of the printer.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A printer comprising:

a frame having a pair of side walls;

a head support member holding a thermal head;

a platen roller rotatably supported on the pair of side walls;

a plurality of elastic members arranged along a longitudinal direction of the head support member to bring the thermal head into contact with a peripheral surface of the platen roller under predetermined loads; and a feeding mechanism which feeds an unwound part of a printing medium while positioning a side edge of the unwound part near one end of the thermal head according to a width of the printing medium selected from among a plurality of printing media having different widths, wherein the predetermined loads by the plurality of elastic members are determined such that a load exerted on the one end of the thermal head is larger than a load exerted on the other end of the thermal head, and wherein a resultant force of the plurality of elastic members acts on a position displaced by a distance obtained by multiplying an entire length of the thermal head by a value in a range of 0.004 to 0.029, the distance measured from a center of the thermal head in the longitudinal direction toward the one end of the thermal head.

2. The printer according to claim 1, wherein the plurality of elastic members are two elastic members placed at positions each dividing equally a length from the center to each end of the thermal head in the longitudinal direction.

3. The printer according to claim 1, wherein the plurality of elastic members are two elastic members placed at positions each dividing equally a length from the center to each end of the thermal head in the longitudinal direction.

4. The printer according to claim 1, wherein the elastic members have equal spring loads, and one of the elastic members is placed close to the one end of the thermal head so that the loading position thereof is outside by a predetermined distance from the one end of the thermal head.

5. The printer according to claim 4, wherein another elastic member is placed close to the other end of the thermal head so that the loading position is inside the end of the thermal head in the longitudinal direction.

6. The printer according to claim 5, wherein the plurality of elastic members are three elastic members spaced at equal intervals along the longitudinal direction of the thermal head.

7. The printer according to claim 4, wherein the plurality of elastic members are three elastic members spaced at equal intervals along the longitudinal direction of the thermal head.

8. A printer comprising:

a frame having a pair of side walls;

a head support member holding a thermal head;

a platen roller rotatably supported on the pair of side walls;

a plurality of elastic members arranged along a longitudinal direction of the head support member to bring the thermal head into contact with a peripheral surface of the platen roller under predetermined loads; and a feeding mechanism which feeds an unwound part of a printing medium while positioning a side edge of the unwound part near one end of the thermal head according to a width of the printing medium selected from among a plurality of printing media having different widths, wherein a pressing force of the elastic member placed close to the one end of the thermal head is determined to be larger than a pressing force of the elastic member placed close to the other end of the thermal head, and wherein a resultant force of the plurality of elastic members acts on a position displaced by a distance obtained by multiplying an entire length of the thermal head by a value in a range of 0.004 to 0.029, the distance measured from a center of the thermal head in the longitudinal direction toward the one end of the thermal head.

* * * * *